US006170934B1

(12) United States Patent
Fujisawa et al.

(10) Patent No.: US 6,170,934 B1
(45) **Date of Patent: *Jan. 9, 2001**

(54) METHOD FOR APPARATUS FOR PRODUCING A NOZZLE PLATE OF AN INK-JET HEAD PRINTER

(75) Inventors: Takanobu Fujisawa; Yoshiaki Kawasaki; Tooru Tsukahara; Terukazu Kawarada; Masaharu Suzuki, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/939,098

(22) Filed: Sep. 26, 1997

(30) Foreign Application Priority Data

Feb. 18, 1997 (JP) ..... 9-033894

(51) Int. Cl.[7] ..... B41J 2/14; B41J 2/16
(52) U.S. Cl. ..... 347/47
(58) Field of Search ..... 347/47, 44, 65

(56) References Cited

U.S. PATENT DOCUMENTS 4,282,533 8/1981 Brooks et al. .
4,425,777 1/1984 Jeglinki .

FOREIGN PATENT DOCUMENTS 639 295 6/1979 (CH) .
195 04 882 A1 2/1994 (DE) .
2 714 629 A1 12/1993 (FR) .
56-049007 5/1981 (JP) .
4-299150 10/1992 (JP) .
5-229127 9/1993 (JP) .
7-60971 3/1995 (JP) .
WO96/41721 12/1996 (JP) .

*Primary Examiner*—John Barlow
*Assistant Examiner*—Michael S. Brooke
(74) *Attorney, Agent, or Firm*—Armstrong, Westerman, Hattori, McLeland & Naughton

(57) ABSTRACT

In a nozzle plate production method and apparatus, a metallic sheet material is punched to form nozzle holes therein by using a press having punches. Each of the punches includes a tapered conical portion, a straight cylindrical portion, and a rounded interconnecting portion. The interconnecting portion smoothly interconnects the conical portion and the cylindrical portion. Nibs produced on a bottom surface of the sheet material at the nozzle holes by the nozzle hole punching are removed by use of a tape grinding machine. A top surface and the bottom surface of the sheet material are buffed to provide a predetermined level of surface roughness. Burrs produced on the top and bottom surfaces of the sheet material at the nozzle holes by the buffing are removed by ultrasonic cleaning.

10 Claims, 22 Drawing Sheets

160
171
157
100a
100
100b
156
163

160
142
a
a'
100a
100
100b
141
163

160
140
22
26
25
141
163
142
100a
100
100b

METHOD FOR APPARATUS FOR PRODUCING A NOZZLE PLATE OF AN INK-JET HEAD PRINTER

BACKGROUND OF THE INVENTION (1) Field of the Invention

The present invention relates to a nozzle plate production method and an apparatus for the same which produces a nozzle plate of an ink-jet head of an ink-jet printer.

Ink discharge characteristics of an ink-jet head of an ink-jet printer affect the quality of a printed image produced by the ink-jet head on a sheet of paper. The ink discharge characteristics are affected by the shape of a nozzle hole of a nozzle plate of the ink-jet head. When it is desired to produce a nozzle plate for an ink-jet head which provides a high quality printed image on the sheet of paper, the shape of the nozzle hole of the nozzle plate is an important factor to consider.

Generally, a large number of small nozzle holes with a given pitch are formed in the nozzle plate of the ink-jet head. It is a difficult task to accurately produce the nozzle plate so as to enable the ink-jet head to provide a high quality printed image, and the cost is likely to be increased. It is therefore desired to provide a nozzle plate production method, and an apparatus for the same, which is capable of easily and accurately producing the nozzle plate with a reduced cost.

(2) Description of the Related Art

Japanese Laid-Open Patent Application No. 7-60971 discloses a conventional nozzle plate of an ink-jet head. FIG. 1 shows a nozzle plate 10 of a piezoelectric ink-jet head disclosed in the above-mentioned publication.

As shown in FIG. 1, the nozzle plate 10 includes a nozzle hole 11. The nozzle hole 11 has a tapered portion 12 on the side of an upper end surface and a straight cylindrical portion 14 on the side of a lower end surface. The tapered portion 12 of the nozzle hole 11 is open to an ink chamber (not shown) of the ink-jet head. The cylindrical portion 14 extends from a bottom edge of the tapered portion 12. The cylindrical portion 14 includes an ink discharge opening 13 from which ink is discharged. In the nozzle plate 10 of the above-mentioned publication, a ridge 15 is formed between the bottom edge of the tapered portion 12 and an upper edge of the cylindrical portion 14.

FIGS. 2A, 2B and 2C show basic processes of a nozzle plate production method disclosed in the above-mentioned publication.

The nozzle hole 11 of the nozzle plate 10 is formed through the nozzle plate production method of FIGS. 2A, 2B and 2C. The tapered portion 12 of the nozzle hole 11 is formed by performing a punching process of FIG. 2A. When the punching process of FIG. 2A is performed, a nib 16 is produced on the bottom of the nozzle plate at the nozzle hole 11. The nib 16 is removed from the nozzle plate by performing a grinding process of FIG. 2B. The cylindrical portion 14 of the nozzle hole 11 is formed by performing a reaming process of FIG. 2C. When the reaming process of FIG. 2C is performed, a burr is produced in the nozzle hole 11. A grinding step is performed to remove the burr from the nozzle hole 11. The nozzle plate 10 of FIG. 1 is thus produced.

In the nozzle plate 10 of the above-mentioned publication, the ridge 15 has a sharp edge and a cross-sectional area of the nozzle hole 11 from the tapered portion 12 to the cylindrical portion 14 does not smoothly change. Therefore, the motion of the meniscus of the ink within the nozzle hole 11 when the ink is discharged from the nozzle hole 11 becomes noncontinuous and unstable, and the ink discharge characteristics of the ink-jet head are degraded.

It is difficult for the ink-jet head having the nozzle plate 10 of the above-mentioned publication to provide a high quality printed image because the ink discharge characteristics of the ink-jet head are low. Further, the nozzle plate production method of producing the nozzle plate 10 of the above-mentioned publication requires both the punching step and the reaming step be accurately performed to form the nozzle hole 11, and it is difficult to reduce the cost for the production of the nozzle plate 10.

SUMMARY OF THE INVENTION

An object of the present invention is to provide an improved nozzle plate production method and apparatus in which the above-mentioned problems are eliminated.

Another object of the present invention is to provide a reduced-cost nozzle plate production method which can easily produce a nozzle plate of an ink-jet head in which nozzle holes are accurately formed in a prescribed configuration that provides good ink discharge characteristics for the ink-jet head.

Still another object of the present invention is to provide a reduced-cost nozzle plate production apparatus which can easily produce a nozzle plate of an ink-jet head in which nozzle holes are accurately formed in a prescribed configuration that provides good ink discharge characteristics for the ink-jet head.

A further object of the present invention is to provide a nozzle plate of an ink-jet head in which nozzle holes are accurately formed in a prescribed configuration enabling the ink-jet head to provide a high quality printed image on a sheet of paper.

The above-mentioned objects of the present invention are achieved by a nozzle plate production method which comprises the steps of: a nozzle hole punching step wherein a metallic sheet material is punched to form nozzle holes therein by using a press including punches, each of the punches comprising a tapered conical portion extending from a base portion of the punch, a straight cylindrical portion extending to a leading edge of the punch, and a rounded interconnecting portion, the rounded interconnecting portion smoothly interconnecting the conical portion and the cylindrical portion; a nib removal step wherein nibs produced on a bottom surface of the sheet material at the nozzle holes by the nozzle hole punching step are removed; a buffing step wherein a top surface and the bottom surface of the sheet material are buffed to provide a predetermined level of surface roughness; and a burr removal step wherein burrs produced on the top and bottom surfaces of the sheet material at the nozzle holes by the buffing step are removed.

The above-mentioned objects of the present invention are achieved by a nozzle plate production apparatus which comprises: a press which punches a metallic sheet material to form nozzle holes therein, the press having punches, each of the punches comprising a tapered conical portion extending from a base portion of the punch, a straight cylindrical portion extending to a leading edge of the punch, and a rounded interconnecting portion, the rounded interconnecting portion smoothly interconnecting the conical portion and the cylindrical portion; a grinding machine for removing nibs produced on a bottom surface of the sheet material at the nozzle holes by the punching of the press; a buffing machine for buffing a top surface and the bottom surface of the sheet material after the nib removal by the buffing machine to provide a predetermined level of surface roughness; and an ultrasonic cleaning machine for removing burrs produced on the top and bottom surfaces of the sheet material at the nozzle holes by the buffing of the buffing machine.

The above-mentioned objects of the present invention are achieved by a nozzle plate of an ink-jet head, the nozzle plate having a plurality of nozzle holes arranged in the nozzle plate, each of the nozzle holes comprising: a tapered conical surface which extends from a top opening of the nozzle hole; a straight cylindrical surface extending from a bottom opening of the nozzle hole; and a rounded interconnecting surface which smoothly interconnects the conical surface and the cylindrical surface.

In the nozzle plate production method and apparatus of the present invention, the nozzle holes of the nozzle plate, each having the conical surface, the interconnecting surface and the cylindrical surface, can be formed by the punching step, and it is possible to easily and accurately produce with a reduced cost the nozzle plate having a prescribed configuration. The punches of the press according to the present invention are provided with the interconnecting portion which smoothly interconnects the conical portion and the cylindrical portion, and it is possible for the nozzle plate production method and apparatus of the present invention to easily produce with a reduced cost a nozzle plate of an ink-jet head in which nozzle holes are accurately formed in a prescribed configuration that provides good ink discharge characteristics for the ink-jet head. Further, it is possible to provide an increased level of tool life for the punches of the press.

In the nozzle plate produced by the nozzle plate production method and apparatus of the present invention, it is possible to provide an increased level of an ink discharge spreading angle when the ink is discharged from the nozzle holes, enabling the ink-jet head to produce a high quality printed image on a sheet of paper. As each of the nozzle holes having the conical surface, the interconnecting surface and the cylindrical surface can be formed by one punching step, it is possible to provide the nozzle plate having the nozzle holes accurately formed in a prescribed configuration. Therefore, it is possible for the ink-jet head to provide a high quality printed image on a sheet of paper.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 3A:
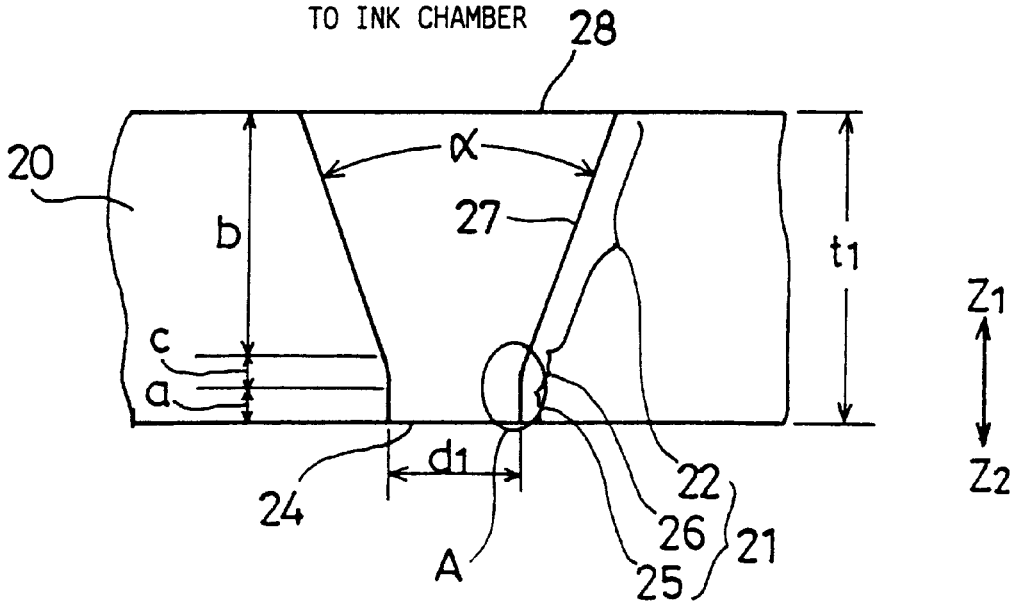
FIGS. 3A and 3B are diagrams showing a nozzle hole in one embodiment of a nozzle plate of the present invention.
Figure 3B:
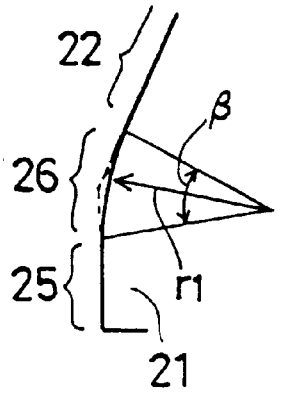

FIG. 3A shows a nozzle hole of one embodiment of a nozzle plate 20 of the present invention. FIG. 3B is an enlarged view of a portion "A" of the nozzle plate 20 of FIG. 3A.

Before the nozzle plate 20 is described with reference to FIGS. 3A and 3B, a description of each of an ink-jet printer and an ink-jet head to which one embodiment of the nozzle plate of the present invention is applied will be given.

Figure 4:
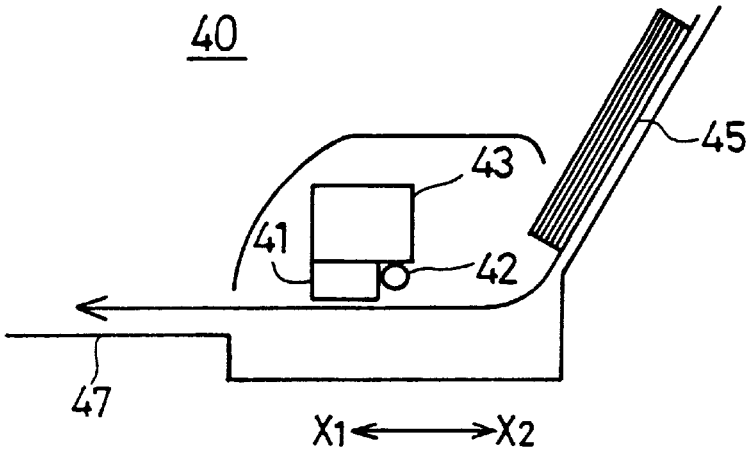
FIG. 4 is a diagram showing an ink-jet printer to which one embodiment of the nozzle plate of the present invention is applied.

FIG. 4 shows an ink-jet printer 40 to which one embodiment of the nozzle plate of the present invention is applied.

As shown in FIG. 4, the printer 40 has a piezoelectric ink-jet head 41 which is movably arranged in the printer 40.

A guide rod 42 is attached to the ink-jet head 41, and the ink-jet head 41 is movable along the guide rod 42 in horizontal directions perpendicular to the plane of the paper of FIG. 4. The ink-jet head 41 comprises one embodiment of the nozzle plate of the present invention. An ink reservoir 43 is attached to the ink-jet head 41 and ink from the ink reservoir 43 is supplied to the ink-jet head 41. A recording sheet 45 is transported within the printer 40, and is passed beneath the bottom of the ink-jet head 41 as indicated by the arrow. The recording sheet is sent to an ejection tray 47 of the printer 40 in a direction (indicated by the arrow "X1" in FIG. 4) after an image is printed on the recording sheet by the ink-jet head 41. When the printing is performed, the ink-jet head 41 reciprocates in a main scanning direction over the recording sheet in either one of the horizontal directions perpendicular to the plane of the paper in FIG. 4.

Figure 5:
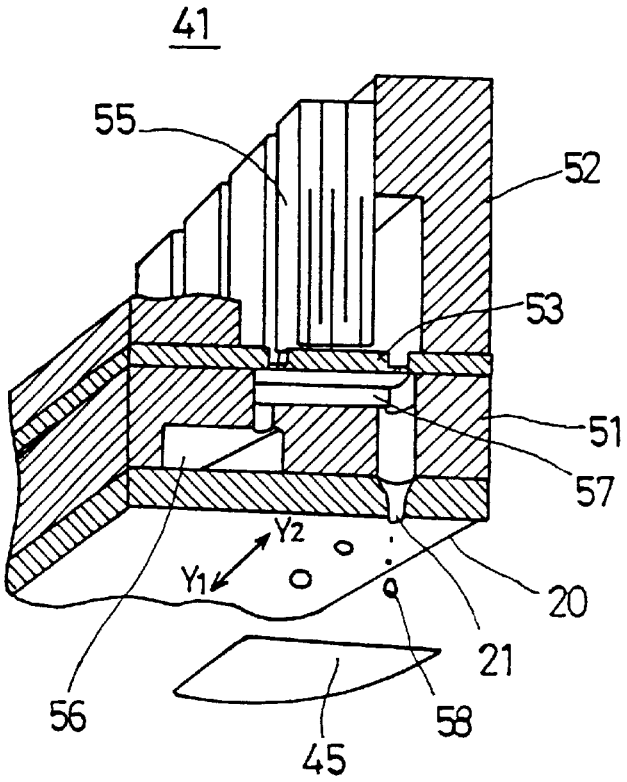
FIG. 5 is an enlarged view of a portion of an ink-jet head of the printer of FIG. 4.

FIG. 5 is an enlarged view of a portion of the ink-jet head 41 of FIG. 4.

As shown in FIG. 5, the ink-jet head 41 comprises the nozzle plate 20, a first member 51 and a second member 52. An oscillation plate 53 is provided between the first member 51 and the second member 52, and the oscillation plate 53 is fixed by the first and second members 51 and 52. The nozzle plate 20 is secured to the bottom of the first member 51. A plurality of piezoelectric elements 55 is secured to the top of the oscillation plate 53. In the first member 51, an ink supply passage 56 and a plurality of ink chambers 57 communicating with the ink supply passage 56 are formed. The nozzle plate 20 includes nozzle holes 21 arranged in rows with a predetermined pitch. One of the nozzle holes 21 of the nozzle plate 20 is open to a related one of the ink chambers 57 of the first member 51. One of the piezoelectric elements 55 corresponds to a related one of the ink chambers 57 of the first member 51, and a base portion of each piezoelectric element 55 is secured to the second member 52 and a leading edge of each piezoelectric element 55 is secured to the oscillation plate 53. The ink from the ink reservoir 43 of the printer 40 is supplied to the ink supply passage 56.

When a driving voltage in a prescribed waveform is supplied to the piezoelectric elements 55, a related one of the piezoelectric elements 55 expands from the original state or contracted back to the original state in a repetitive manner. Such displacements of the related piezoelectric element 55 are transferred to the oscillation plate 53 so that the oscillation plate 53 is oscillated. The ink within the ink supply chamber 56 is supplied to a related one of the ink chambers 57 when a related one of the piezoelectric elements 55 is contracted back to the original state. The ink within the related ink chamber 57 is discharged from a related one of the nozzle holes 21 to the recording sheet 45 when the related piezoelectric element 55 expands from the original state to press the oscillation plate 53. The amount of ink being discharged from one of the nozzle holes 21 is of the order of some tens of pico-liters ($10^{-12}$ liters). In this manner, the ink within the ink chamber 57 is discharged from the nozzle hole 21 of the nozzle plate 20, and an ink droplet 58 is fixed to the recording sheet 45.

A main scanning over the recording sheet 45 by the ink-jet head 41 is performed in either one of the horizontal directions indicated by the arrows Y1 and Y2 in FIG. 5. One of the directions Y1 and Y2 in which the main scanning is performed by the ink-jet head 41 is called a main scanning direction. As shown in FIG. 4, the recording sheet 45 is sent to the ejection tray in the direction indicated by the arrow X1. Such a movement of the ink-jet head 41 relative to the recording sheet 45 is called sub-scanning, and the direction in which sub-scanning over the recording sheet 45 by the ink-jet head 41 is performed is called a sub-scanning direction.

Figure 6:
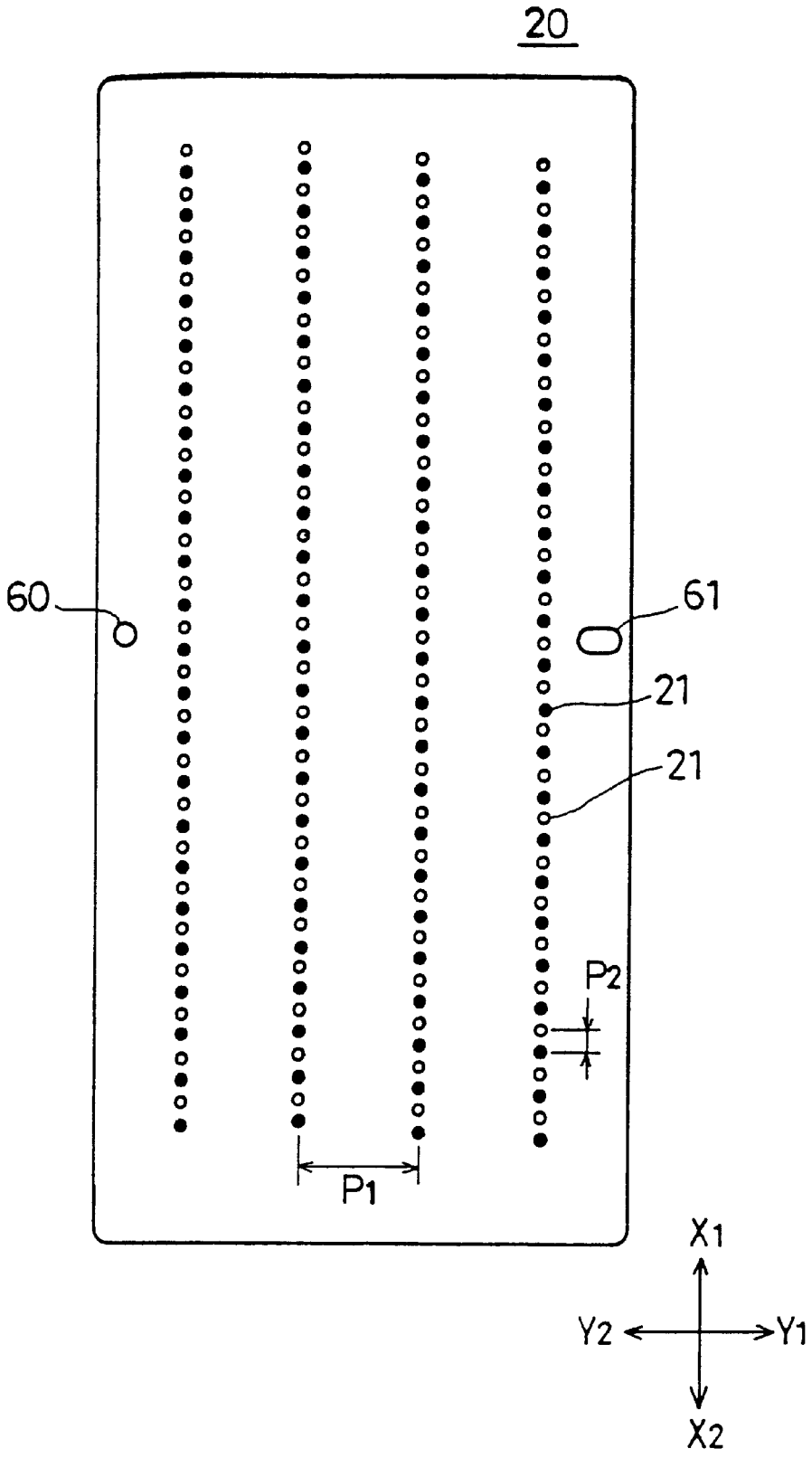
FIG. 6 is a view of the embodiment of the nozzle plate of the present invention.

FIG. 6 shows an embodiment of the nozzle plate 20 of the present invention. As shown in FIG. 6, The nozzle plate 20 has base holes 60 and 61 at side portions. The nozzle plate 20 has a plurality of nozzle holes 21 which are arranged in rows. In the present embodiment, each of the rows includes fifty four nozzle holes 22 which are arrayed in the sub-scanning direction with a pitch P2 between two of the nozzle holes 22 in the sub-scanning direction. A pitch P1 between two of the rows of the nozzle holes 22 in the main scanning direction is set at a predetermined distance. In the present embodiment, the pitch P1 is set at about 3.7 mm, and the pitch P2 is set at about 0.3 mm.

The nozzle plate 20 of FIGS. 3A and 3B is made of a stainless steel material. The nozzle plate 20 in this embodiment has a thickness "t1" which is equal to about 0.08 mm. For the sake of convenience, the side of a lower end surface of the nozzle plate 20 from which the ink is discharged in a direction indicated by the arrow Z2 in FIG. 3A is called a front end of the nozzle plate, and the side of an upper end surface of the nozzle plate 20 in which the nozzle holes 21 are open to the ink chambers 57 of the ink-jet head 41 in a direction indicated by the arrow Z1 in FIG. 3A is called a rear end of the nozzle plate.

The nozzle plate 20 of the present invention is characterized by the shape of the nozzle holes 21 which is particularly determined by the inventors in order to provide good ink discharge characteristics for the ink-jet head. This shape of the nozzle holes 21 is determined on the basis of the results of observations regarding ink discharge characteristics which will be described later.

Next, a description will be given, with reference to FIGS. 3A and 3B, of the configuration of each of the nozzle holes 21 in the present embodiment of the nozzle plate 20.

As shown in FIGS. 3A and 3B, the nozzle plate 20 has a front-end opening 24 on the front-end side of the nozzle plate 20 and a rear-end opening 28 on the rear-end side thereof. When the nozzle plate 20 is installed in the ink-jet head 41, the rear-end opening 28 of the nozzle plate 20 is open to a related one of the ink chambers 57 of the ink-jet head 41.

The nozzle hole 21 has a tapered conical surface 22 extending from the rear-end opening 28, a straight cylindrical surface 25 extending from the front-end opening 24, and a rounded interconnecting surface 26. The rounded interconnecting surface 26 smoothly interconnects a front end edge of the conical surface 22 and a rear end edge of the cylindrical surface 25. It should be noted that the interconnecting surface 26 is smoothly continuous to each of the conical surface 22 and the cylindrical surface 25.

In the present embodiment of the nozzle plate 20, the front-end opening 24 has a diameter "d1" which is set at about 0.03 mm. The cylindrical surface 25 has a depth "a" which is set at about 0.01 mm. That is, in the nozzle plate 20 of the present invention, the depth "a" of the cylindrical surface 25 is set at about one eighth of the thickness t1 of the nozzle plate 20. The conical surface 22 has a cone angle "$\alpha$" which is set at about 40°. The conical surface 22 has a depth "b" which is set at about 0.06 mm. That is, in the nozzle plate 20 of the present invention, the depth "b" of the conical surface 22 is set at about five eighths of the thickness t1 of the nozzle plate 20. The conical surface 22 has a cross-section which is represented by a straight line 27 in FIG. 3A.

Further, in the present embodiment of the nozzle plate 20, as shown in FIG. 3B, the interconnecting surface 26 has a radius "r1" which is set at about 0.03 mm, and has an angle "β" between the radii "r1" which is set at about 20°. As shown in FIG. 3A, the interconnecting surface 26 has a depth "c" which is set at about 0.02 mm. That is, in the nozzle plate 20 of the present invention, the depth "c" of the interconnecting surface 26 is set at about one fourth of the thickness t1 of the nozzle plate 20.

Further, in the present embodiment of the nozzle plate 20, the surface roughness of each of the conical surface 22, the interconnecting surface 26 and the cylindrical surface 25 is set to a predetermined level. In the nozzle plate 20 of the present invention, the motion of the meniscus of the ink within the nozzle hole 21 when the ink is discharged from the nozzle hole 21 is constant and stable. Therefore, it is possible for the nozzle plate 20 of the present invention to provide good ink discharge characteristics for the ink-jet head 41.

Figure 7A:
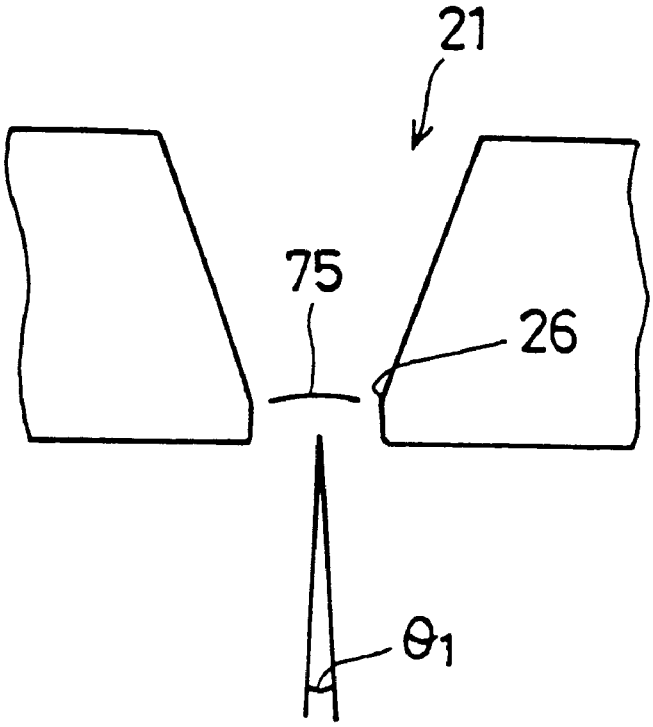
FIGS. 7A and 7B are diagrams for explaining ink discharge characteristics of the nozzle plate of FIGS. 3A and 3B.
Figure 7B:
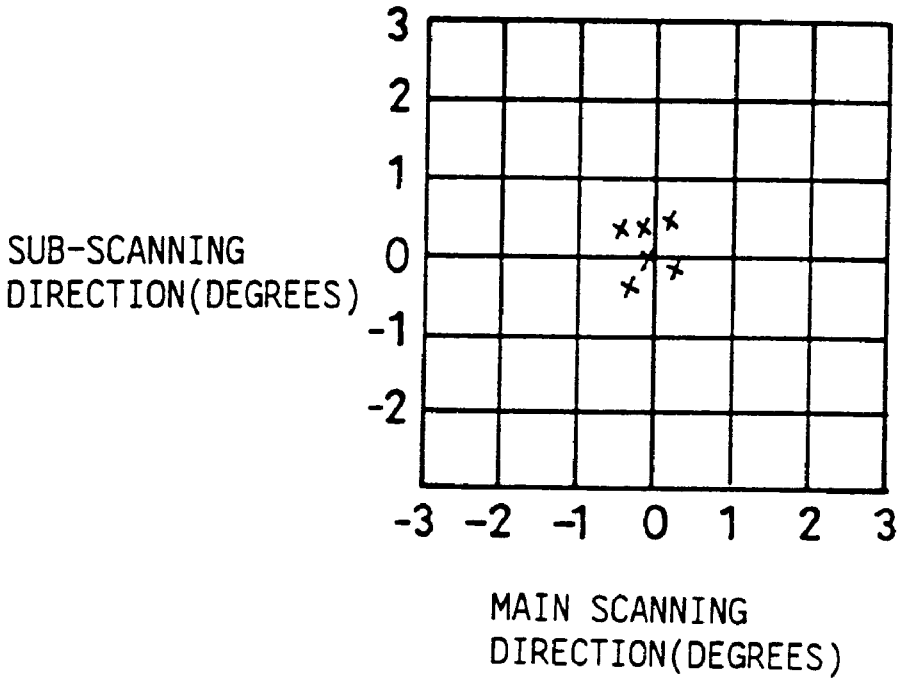
Figure 8A:
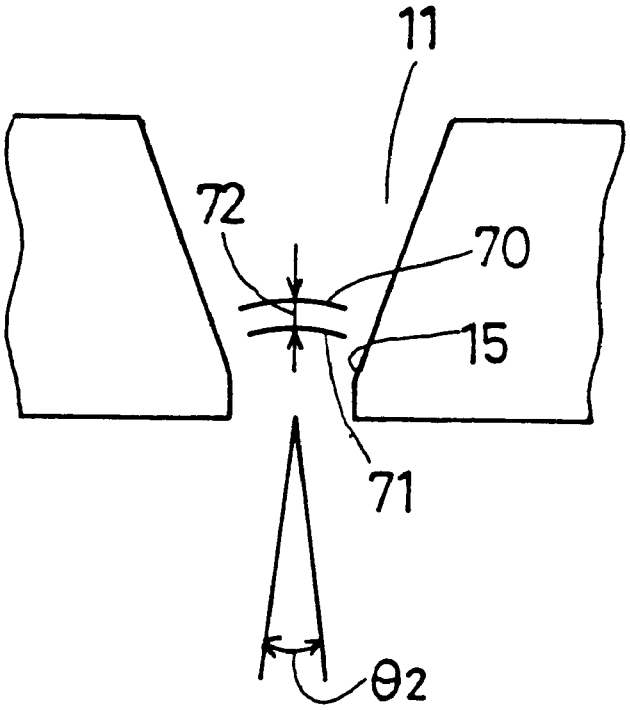
FIGS. 8A and 8B are diagrams for explaining ink discharge characteristics of a comparative example of the nozzle plate having no rounded interconnecting surface.
Figure 8B:
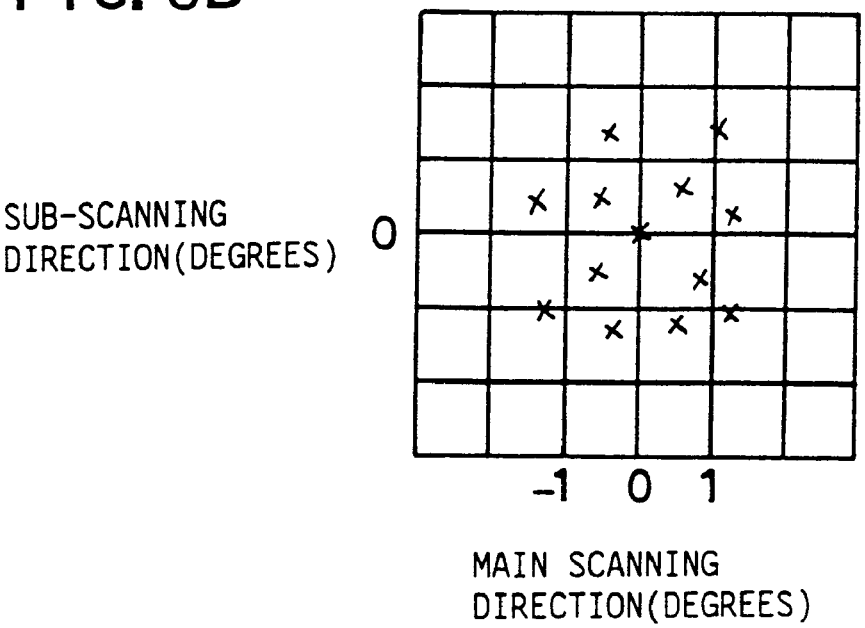

FIGS. 7A and 7B show ink discharge characteristics provided by the nozzle plate 20 of FIGS. 3A and 3B. FIGS. 8A and 8B show ink discharge characteristics provided by a comparative example of a nozzle plate which does not have a rounded interconnecting surface.

FIG. 7A shows the nozzle plate 20 having the rounded interconnecting surface 26 in the nozzle hole 21 wherein other elements are the same as those the nozzle plate 20 of FIGS. 3A and 3B. FIG. 8A shows the nozzle plate 10 (the comparative example) having the ridge 15 with a sharp edge in the nozzle hole 11 instead of the rounded interconnecting surface 26. The plots of ink dots, shown in FIG. 7B and FIG. 8B, are obtained according to the results of observation of the ink discharge performed with the nozzle plate 20 of FIG. 7A and the comparative example of FIG. 8A, respectively.

In the case of the comparative example of FIG. 8A, the meniscus of the ink within the nozzle hole 11 when the ink is discharged from the nozzle hole 11 may be irregularly moved within a range 72 between a line 70 and a line 71 indicated in the FIG. 8A, and the motion of the ink meniscus becomes noncontinuous and unstable. The plots of ink dots obtained according to the results of observation of the ink discharge performed with the nozzle plate 10 of FIG. 8A are shown in FIG. 8B. As shown in FIG. 8B, an ink discharge spreading angle θ2 of the comparative example is ±1.3 degrees. It may be concluded that the ink discharge spreading angle θ2 of the comparative example is relatively large because the motion of the ink meniscus at the ink discharge opening disperses.

Figure 9A:
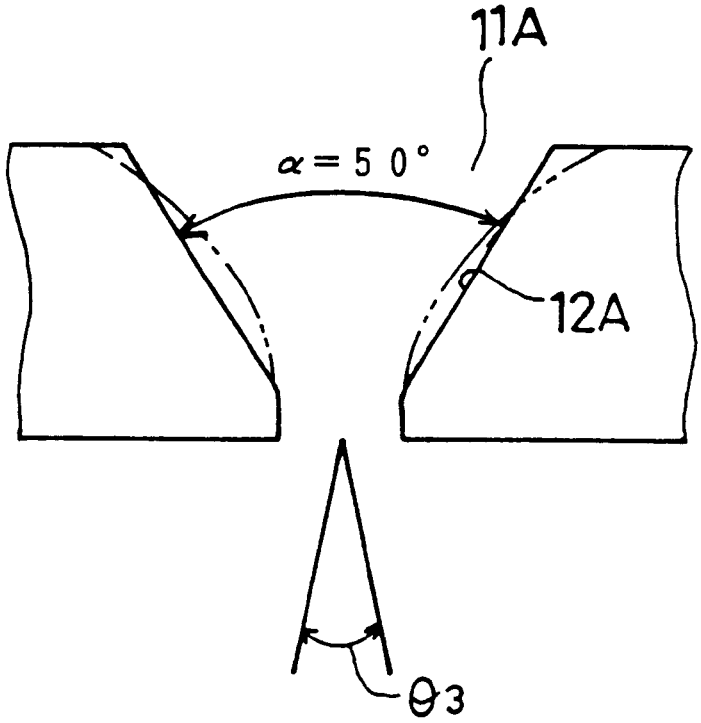
FIGS. 9A and 9B are diagrams for explaining ink discharge characteristics of a comparative example of the nozzle plate having an increased cone angle.
Figure 9B:
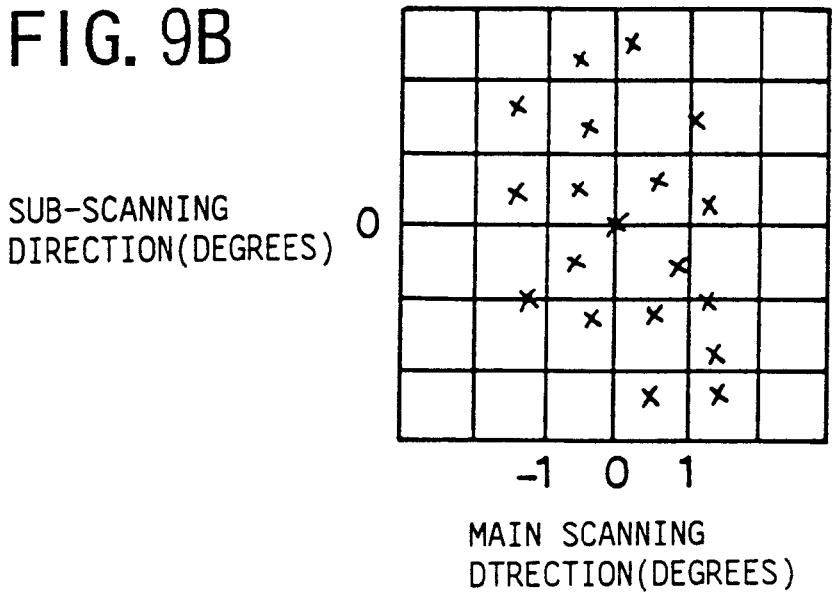

FIGS. 9A and 9B show ink discharge characteristics of another comparative example of the nozzle plate having an increased cone angle. FIG. 9A shows a nozzle plate 10A (the comparative example) which includes a nozzle hole 11A having a tapered portion 12A with a cone angle α=50°. As described above, the cone angle α of the tapered conical surface 22 of the nozzle plate 20 of FIG. 7A is about 40°. The plots of ink dots, shown in FIG. 9B, are obtained according to the results of observation of the ink discharge performed with the nozzle plate 10A of FIG. 9A.

In the case of the comparative example of FIG. 9A, as shown in FIG. 9B, an ink discharge spreading angle θ3 of the nozzle plate 10A is greater than that of the nozzle plate 10. It may be concluded that the ink discharge spreading angle θ3 of the nozzle plate 10A is relatively large because the direction of the ink discharge by the nozzle plate 10A from the ink discharge opening disperses considerably more than that of the nozzle plate 20.

In the case of the nozzle plate 20 of FIG. 7A, the meniscus of the ink within the nozzle hole 21 when the ink is discharged from the nozzle hole 21 is constantly set at around a line 75 indicated in the FIG. 7A, and the motion of the ink meniscus becomes constant and stable. The plots of ink dots obtained according to the results of observation of the ink discharge performed with the nozzle plate 20 of FIG. 7A are shown in FIG. 7B. As shown in FIG. 7B, an ink discharge spreading angle θ1 of the nozzle plate 20 is ±0.4 degrees which is smaller than that of the comparative examples of FIGS. 8A and 9A. It may be concluded that the ink discharge spreading angle θ1 of the comparative example is relatively small because the nozzle plate 20 has the rounded interconnecting surface 26 (or the motion of the ink meniscus is constant and stable) and the cone angle α of the nozzle plate 20 is set at about 40° (or the direction of the ink discharge by the nozzle plate 20 from the ink discharge opening is constant and stable).

Next, a description will be given of a nozzle plate production method and an apparatus for the same according to the present invention.

Figure 10:
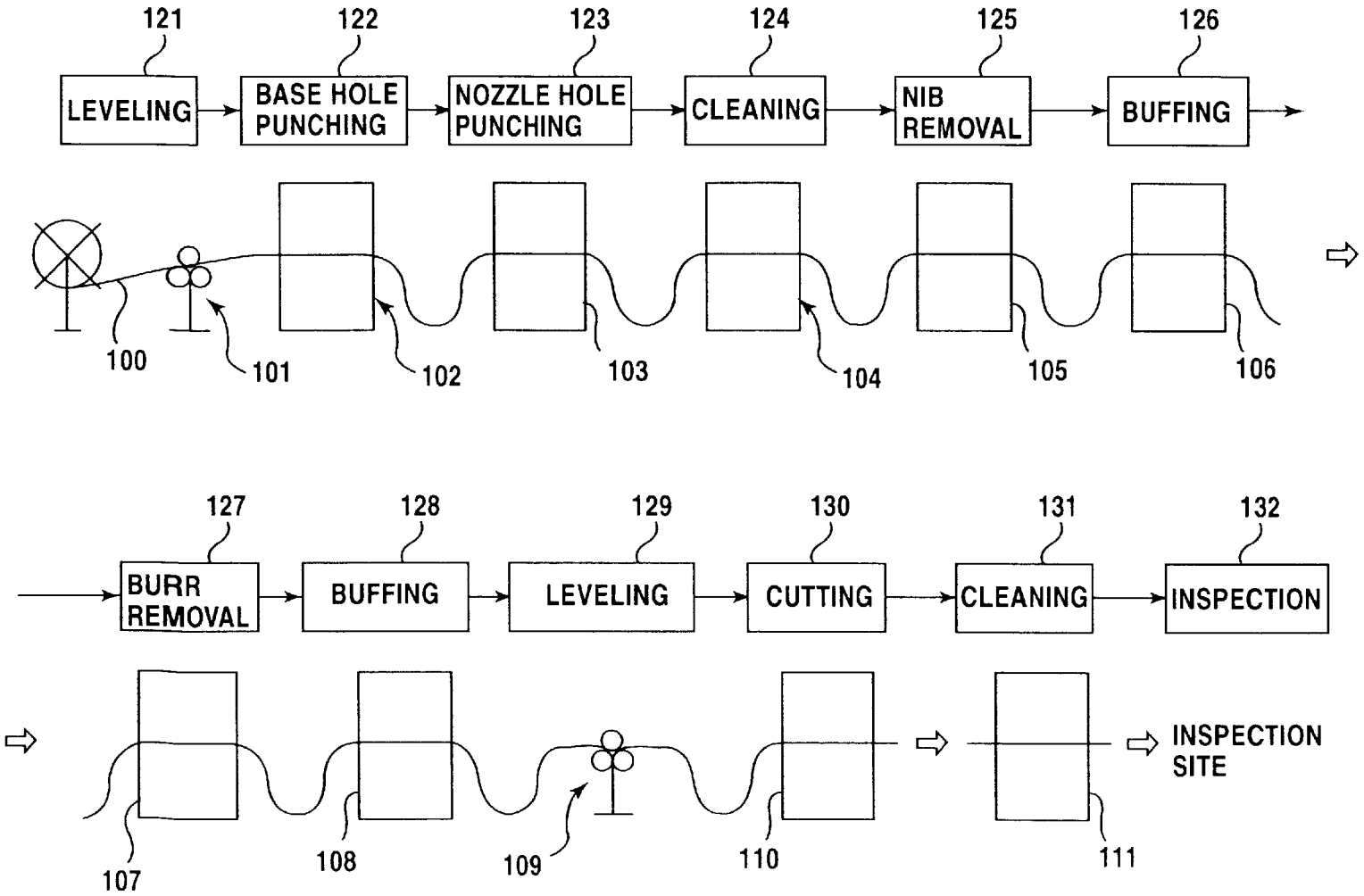
FIG. 10 is a diagram for explaining a nozzle plate production method and an apparatus for the same according to the present invention.
Figure 11:
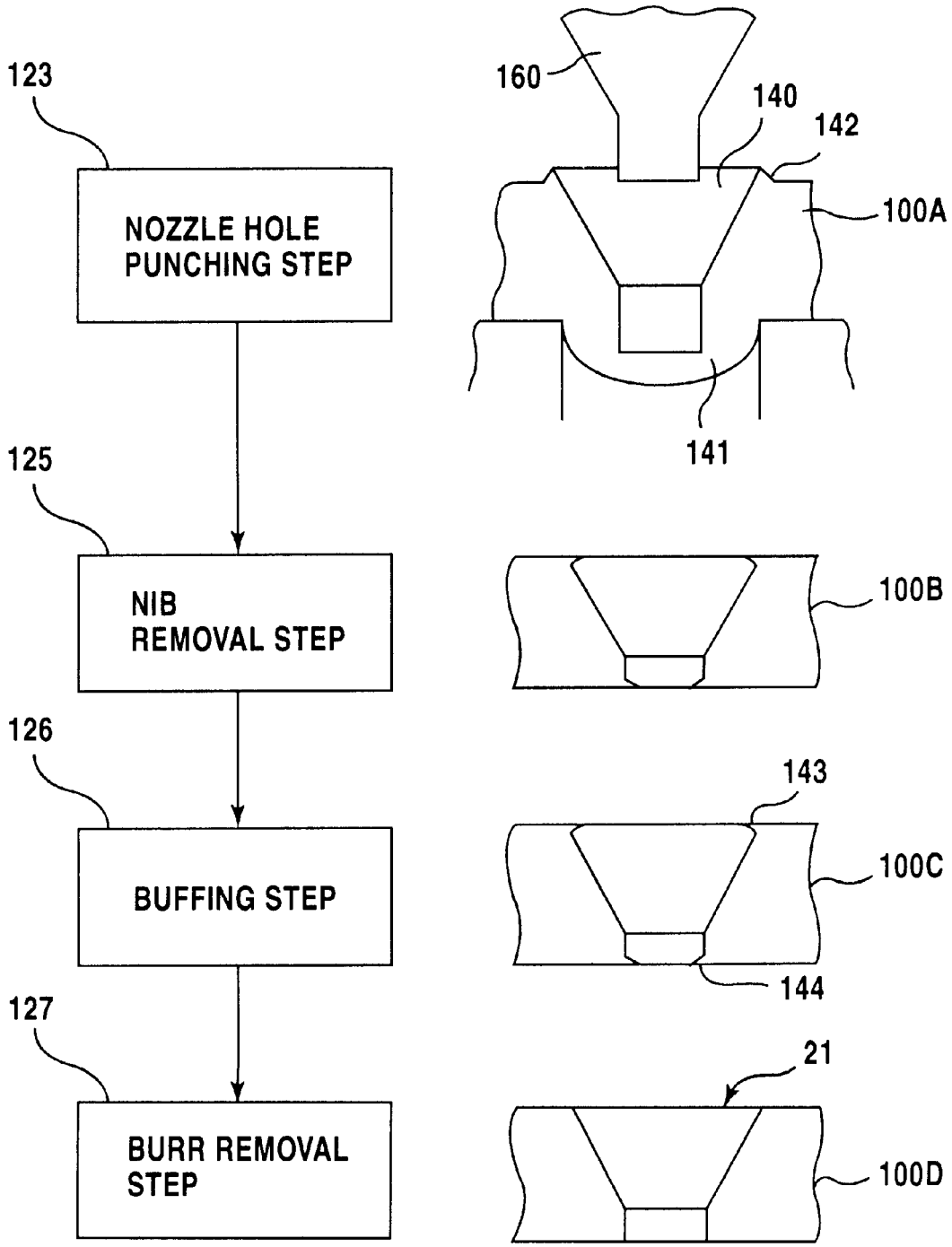
FIG. 11 is a diagram for explaining basic processes of the nozzle plate production method and basic elements of the nozzle plate production apparatus.

FIG. 10 shows a nozzle plate production method and an apparatus for the same according to the present invention. FIG. 11 shows basic processes of the nozzle plate production method and basic elements of the nozzle plate production apparatus.

As shown in FIGS. 10 and 11, the nozzle plate production method of the present invention comprises a leveling step 121, a base hole punching step 122, a nozzle hole punching step 123, a cleaning step 124, a nib removal step 125, a buffing step 126, a burr removal step 127, a buffing step 128, a leveling step 129, a cutting step 130, a cleaning step 131, and an inspection step 132.

In the leveling step 121, a hooped sheet material 100 of stainless steel is leveled by using a roller leveler 101. In the base hole punching step 122, base holes (corresponding to the base holes 60 and 61) in a sheet material 100A (or the sheet material 100 after the leveling step 121 is performed) are formed by using a press 102. In the nozzle hole punching step 123, nozzle holes 140 (corresponding to the nozzle holes 21) in the sheet material 100A are punched by using a press 103 including punches 160. The punches 160 which will be described later are used to punch the nozzle holes 140 in the sheet material 100A. In the nozzle hole punching step 123, nibs 141 on the bottom of the sheet material 100A at the nozzle holes 140 are produced.

In the cleaning step 124, a machining oil used in the punching steps 122 and 123 is removed by using an ultrasonic cleaning machine 104. In the nib removal step 125, the nibs 141 are ground and removed from a sheet material 100B (or the sheet material 100A after the punching step 123 is performed) by using a tape grinding machine 105. As shown in FIG. 11, the nozzle holes 140 after the nibs 141 are removed are formed as through holes that extend from the top of the sheet material 100B to the bottom of the sheet material 100B. Further, in the nib removal step 125, raised portions 142 which are produced on the top of the sheet material 100B at the nozzle holes 140 in the nozzle hole punching step 123 are ground and removed from the sheet material 100B by the tape grinding machine 105.

In the buffing step 126, top and bottom surfaces of a sheet material 100C (or the sheet material 100B after the nib removal step 125 is performed) are buffed to provide a predetermined level of surface roughness by using a buffing machine 106. In the burr removal step 127, burrs 143 and 144 which are produced on the top and bottom surfaces of a sheet material 100D (or the sheet material 100C after the buffing step 126 is performed) at the nozzle holes 140 in the buffing step 126 are removed by using an ultrasonic machine 107. Alumina chips are used by the ultrasonic machine 107 to remove the burrs 143 and 144 in the burr removal step 127.

In the buffing step 128, the top and bottom surfaces of the sheet material 100D are buffed to provide a predetermined level of surface roughness by using a buffing machine 108. In the leveling step 129, the sheet material 100D is leveled by using a roller leveler 109. In the cutting step 130, the leveled sheet material 100D is cut into the nozzle plates 20 by using a press 110. In the cleaning step 131, a machining oil used in the cutting step 130 is removed from the nozzle plates 20 by using an ultrasonic cleaning machine 111. Finally, in the inspection step 132, the nozzle plates 20 are delivered to an inspection site in which the produced nozzle plates 20 are subjected to inspection.

Figure 12:
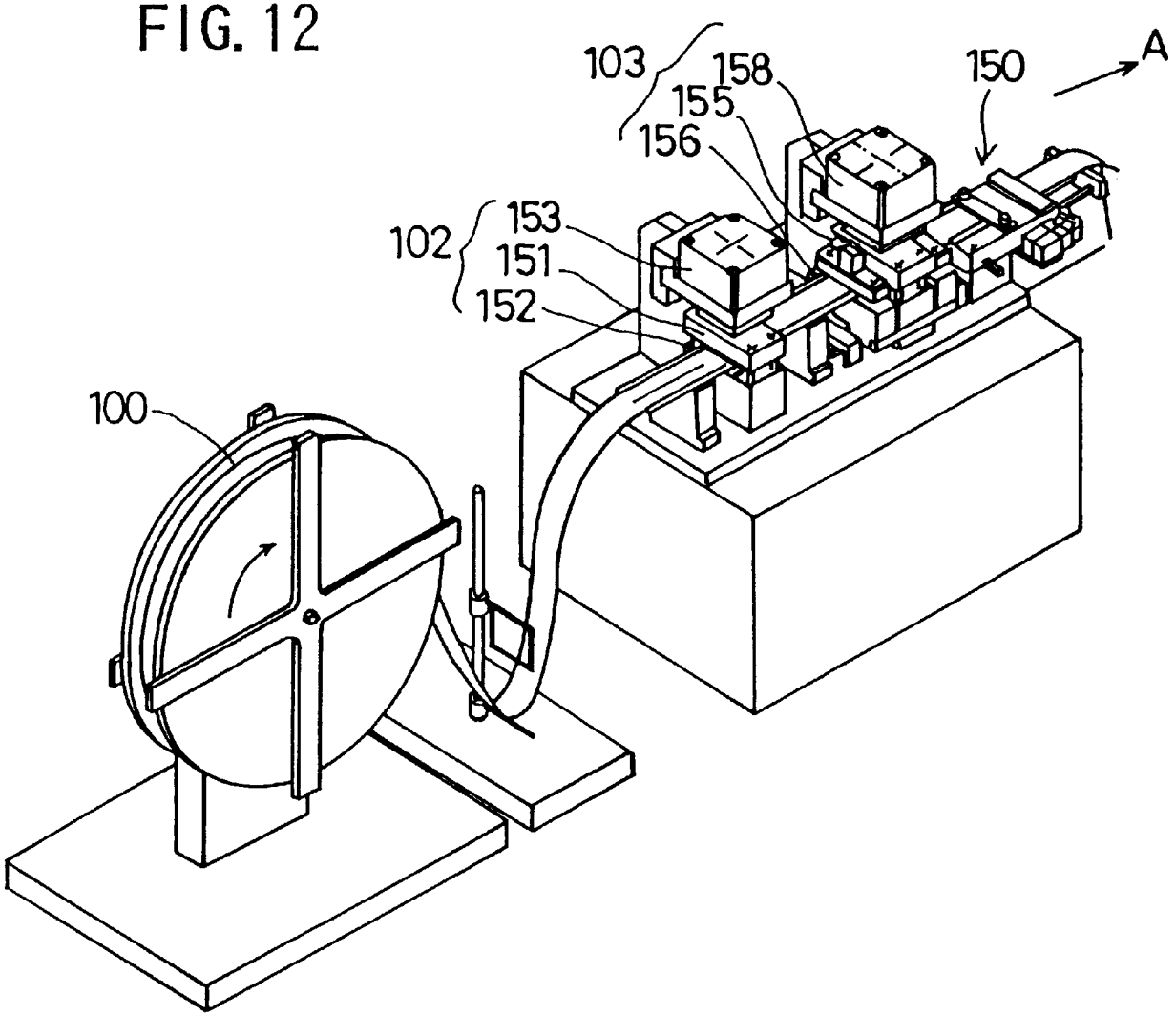
FIG. 12 is a view of a press used in a nozzle hole punching step of the nozzle plate production method of the present invention.
Figure 13A:
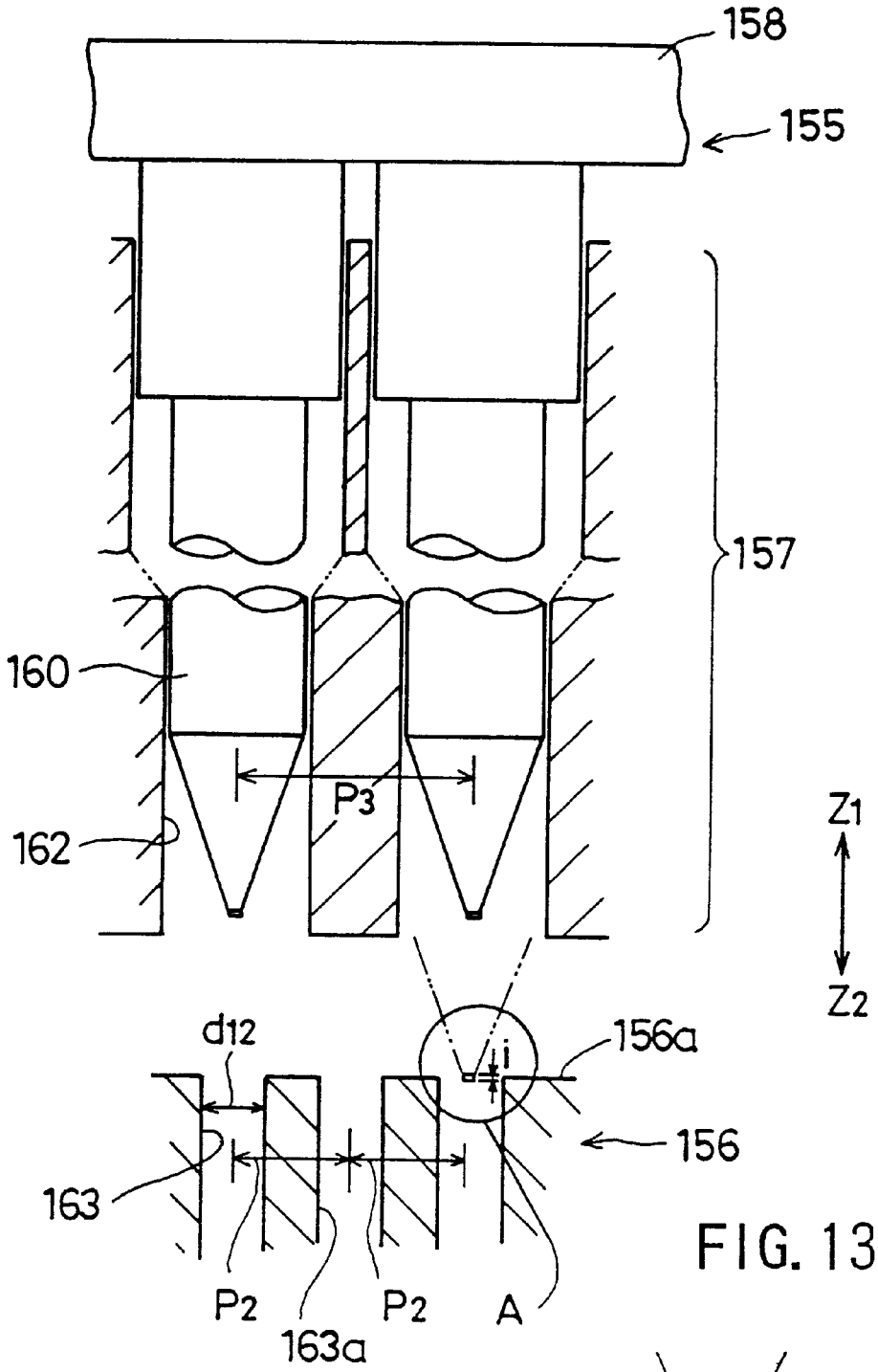
FIGS. 13A and 13B are diagrams showing punches of the press used in the nozzle hole punching step.
Figure 13B:
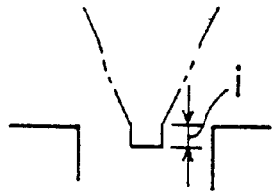

FIG. 12 shows the press 102 used in the base hole punching step 122 and the press 103 used in the nozzle hole punching step 123. FIG. 13A shows the punches 160 of the press 103 used in the nozzle hole punching step 123. FIG. 13B shows details of a portion "A" of one of the punches 160 indicated in FIG. 13A.

As shown in FIG. 12, the sheet material 100 of stainless steel is delivered to the presses 102 and 103 in a direction indicated by the arrow A by a feeder 150. The press 102 includes an upper die 151 having base hole punches, a lower die 152, and a base 153. The upper die 151 is secured to the base 153, and a drive unit of the press 102 moves the base 153 up and down so that the upper die 151 is moved up and down to the lower die 152. By using the press 102, the base holes 60 and 61 in the sheet material 100 are formed.

As shown in FIGS. 13A and 13B, the press 103 includes an upper die 155 having the punches 160, a lower die 156, a holding plate 157, a base 158, and a feeder 250. The upper die 155 is secured to the base 158, and a drive unit of the press 103 moves the base 158 up and down so that the upper die 155 is moved up and down relative to the lower die 156. The sheet material 100 is held by the holding plate 157. The feeder 250 will be described later.

Figure 14:
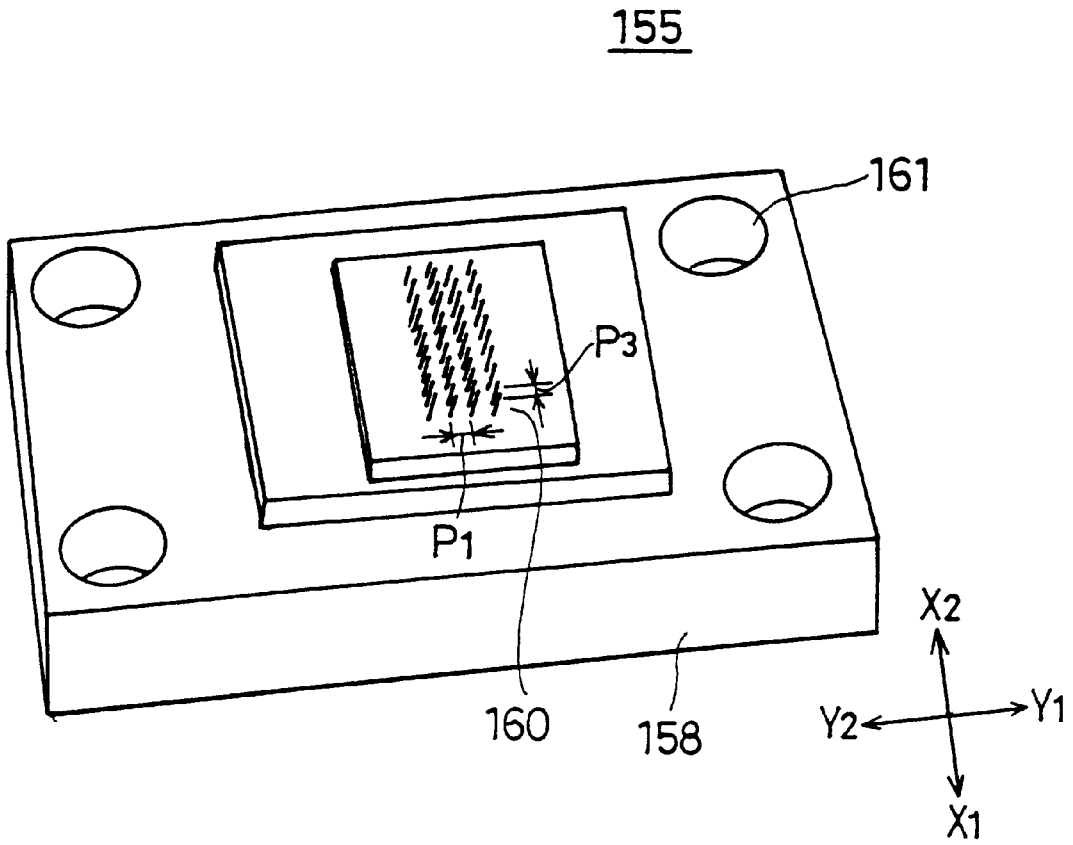
FIG. 14 is a bottom view of an upper die including the punches of FIG. 13A.
Figure 15A:
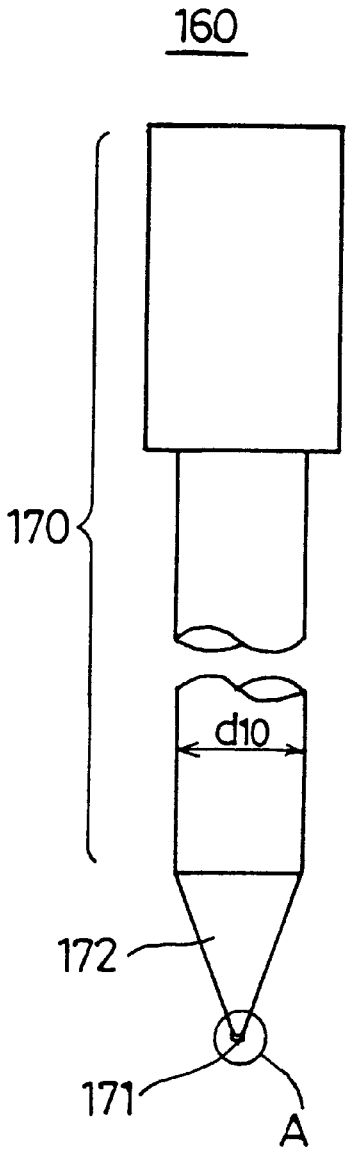
FIGS. 15A and 15B are diagrams showing details of one of the punches of FIG. 13A.
Figure 15B:
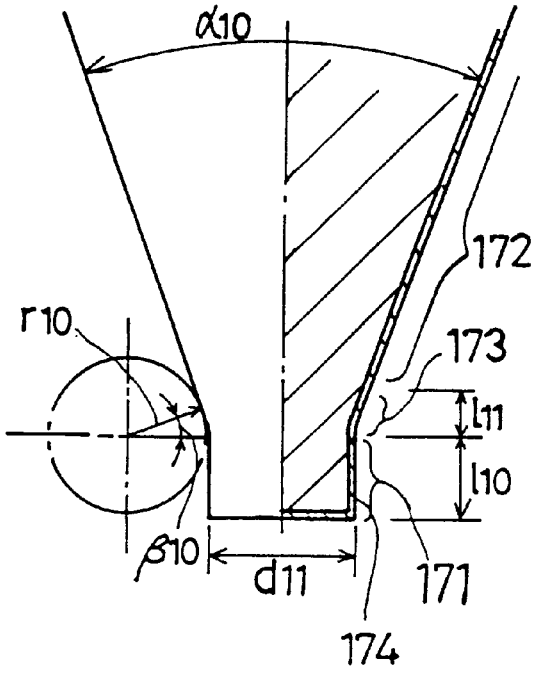

FIG. 14 is a bottom view of the upper die 155 including the punches 160 of FIG. 13A. FIG. 15A shows details of one of the punches 160 of FIG. 13A, and FIG. 15B shows details of a portion "A" of the punch 160 indicated in FIG. 15A.

As shown in FIG. 14, the upper die 155 includes the punches 160 embedded therein and is secured to the base 158. The base 158 includes guide holes 161 at four corners of the base 158. The guide holes 161 are fitted to guide pins which are secured to the lower die 156 at four corners of the lower die 156. In the upper die 155, the punches 160 are arranged in rows, and the arrangement of the punches 160 in the upper die 155 is similar to the arrangement of the nozzle holes 21 in the nozzle plate 20 shown in FIG. 6. In the present embodiment, the punches 160 in each of the rows of the upper die 155 are arrayed in the sub-scanning direction with a pitch P3 between two of the punches 160 in the main scanning direction. A pitch P1 between two of the rows of the punches 160 in the main scanning direction is set at a predetermined distance. In the present embodiment, the pitch P1 of the punches 160 is set at about 3.7 mm which is the same as the pitch P1 of the nozzle holes 21, and the pitch P3 of the punches 160 is set at about 0.6 mm which is twice the pitch P2 of the nozzle holes 21.

As shown in FIG. 13A, the holding plate 157 include a plurality of guide holes 162, and the guide holes 162 are arranged in rows such that the arrangement of the guide holes 162 in the holding plate 157 corresponds to the arrangement of the punches 160 in the upper die 155.

The lower die 156 includes, as shown in FIG. 13A, a plurality of die holes 163, and the die holes 163 are arranged in rows. In the lower die 156, the die holes 163 in each of the rows are arrayed with a pitch P2 which is the same as the pitch P2 of the nozzle holes 21 in the nozzle plate 20. That is, the pitch P2 between two of the die holes 163 in the lower die 156 is half the pitch P3 of the punches 160 in the upper die 155. In the lower die 156 of FIG. 13A, the die holes 163 include die holes 163 which are directed to the punches 160 of the upper die 155 and die holes 163*a* which are directed to the midpoints between the punches 160, which will be described later.

The guide holes 161 of the base 158 are fitted to the guide pins secured to the lower die 156, and the punches 160 of the upper die 155 are contained in the guide holes 162 of the holding plate 157.

As shown in FIGS. 15A and 15B, the punch 160 (or one of the punches 160 of the upper die 155) has a base portion 170, a tapered conical portion 172 extending from the base portion 170, a straight cylindrical portion 171, and a rounded interconnecting portion 173. The rounded interconnecting portion 173 annularly connects a front end edge of the conical portion 172 with a rear end edge of the cylindrical portion 171. It should be noted that the rounded interconnecting portion 173 is smoothly continuous to each of the conical portion 172 and the cylindrical portion 171.

In the present embodiment of the punch 160, the base portion 170 has a diameter "d10" which is set at about 0.4 mm. The cylindrical portion 171 has a diameter "d11" which is set at about 0.03 mm, and a height "110" which is set at about 0.02 mm. The conical portion 172 has a cone angle "$\alpha$10" which is set at about 40°.

Further, in the present embodiment of the punch 160, the shape of the punch 160 has been particularly determined by the inventors in order to provide good ink discharge characteristics for the ink-jet head 41. The shape of the punch 160 is determined on the basis of the shape of the nozzle hole 21 in the nozzle plate 20 described above. In particular, the interconnecting portion 173 has, as shown in FIG. 15B, a radius "r10" which is set at about 0.03 mm, and has an angle "$\beta$10" between the radii "r10" which is set at about 20°. The interconnecting portion 173 has a height "111" which is set at about 0.02 mm.

In a case of a punch having no rounded interconnecting portion 173, the conical portion 172 and the cylindrical portion 171 in the punch are interconnected by a fillet. Generally, such a fillet is naturally produced by a sharp corner of a cutting tool through machining, and the fillet usually has a radius which is about 0.01 mm. That is, in the present embodiment of the punch 160, the rounded interconnecting portion 173 has the radius "r10" which is much larger (about three times) than the radius of the naturally produced fillet. As the present embodiment of the punch 160 has the increased radius "r10" of the interconnecting portion 173, it is possible to provide an increased tool life for the punch 160.

Further, in the present embodiment of the punch 160, the punch 160 is made of a cemented carbide material, and produced from the cemented carbide material by using a centreless grinding machine.

As shown in FIG. 15B, the punch 160 further includes a protective film layer 174 on the outside surface of the punch 160 so that the protective film layer 174 covers the conical portion 172, the interconnecting portion 173 and the cylindrical portion 171. The protective film layer 174 is made of titanium nitride (TiN), and formed on the outside surface of the punch 160 through ion plating. In FIG. 15B, the protective film layer 174 is indicated with an enlarged thickness which is greater than the actual thickness thereof, for the sake of convenience.

As the present embodiment of the punch 160 includes the protective film layer 174, it is possible to provide a reduced coefficient of friction between the punch 160 and the sheet material 100, and the reduced coefficient of friction is less than that of a punch which does not have a protective film layer.

Further, in the present embodiment of the punch 160, the front-end portion of the punch 160, that is: the conical portion 172, the interconnecting portion 173 and the cylindrical portion 171, is finished by lapping so that the surfaces of these portions provide a predetermined level of surface roughness.

In the lower die 156, the die holes 163 have a diameter "d12" (shown in FIG. 13A) which is set at about 0.2 mm. The diameter "d12" (about 0.2 mm) of the die holes 163 is much larger than the diameter "d11" (about 0.03 mm) of the cylindrical portion 171 of the punch 160. The diameters "d12" and "d11" are determined such that the nibs on the bottom of the sheet material 100 are produced in equal volume in the nozzle hole punching step 123. It is observed that, when the diameter "d11" of the cylindrical portion 171 is in a range between 0.02 mm and 0.05 mm, the diameter "d12" of the die holes 163 in a range between 0.07 mm and 0.2 mm is appropriate for this purpose.

In FIGS. 13A and 13B, a lowermost position of the leading edge of the punch 160 during the nozzle hole punching step 123 is indicated by a two-dot chain line. In the present embodiment, each of the punches 160 of the upper die 155 is arranged such that the leading edge of the punch 160 when it is at the lowermost position projects from a top surface 156*a* of the lower die 156 into the related die hole 163 by a dimension "i". The dimension "i" is determined to ensure that the cylindrical surface 25 of the nozzle hole 21 of the nozzle plate 20 being produced has the above-mentioned depth "a". The dimension "i" in the present embodiment is set at about 0.01 mm.

Figures 16A, 16B, 16C:
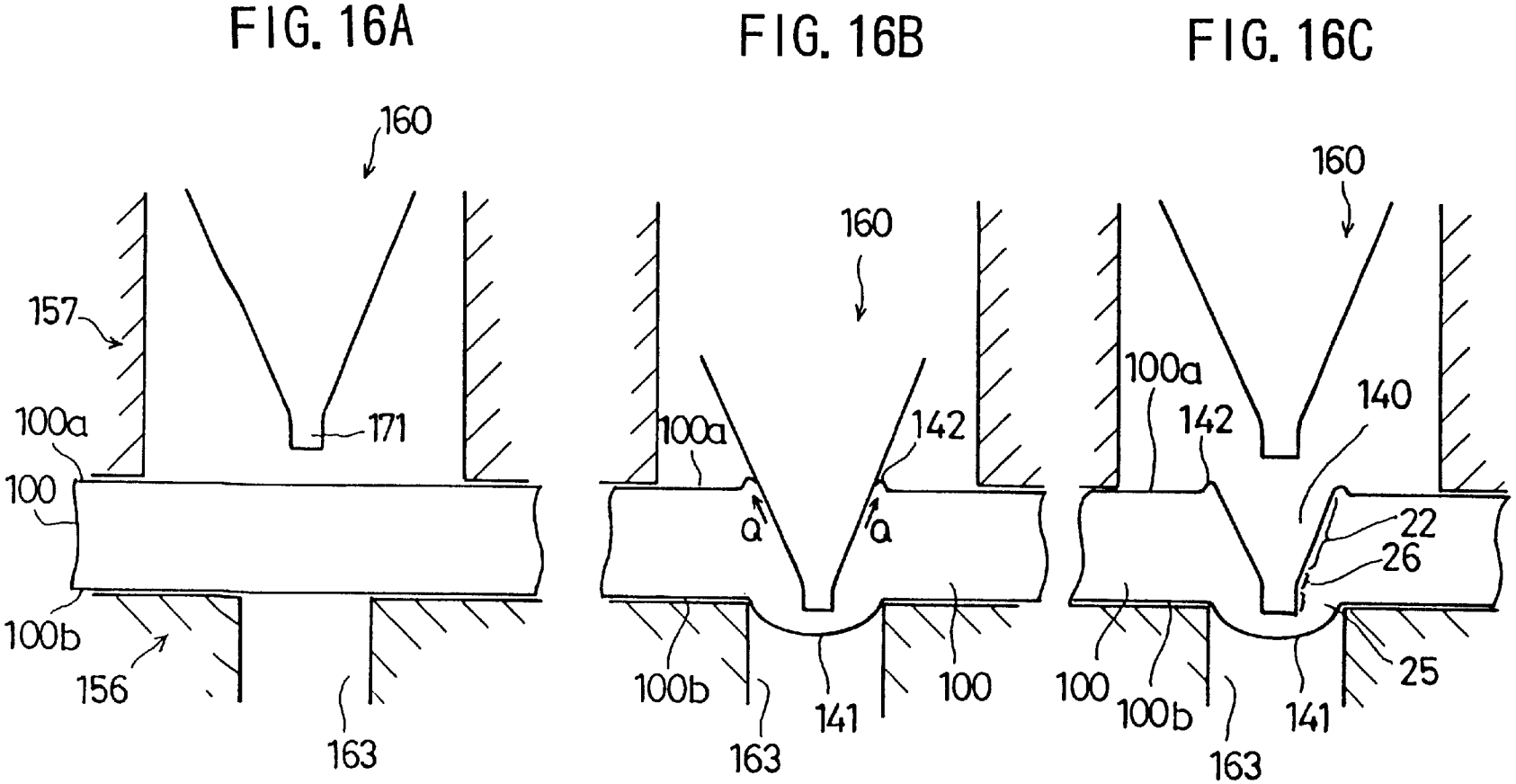
FIGS. 16A, 16B and 16C are diagrams for explaining the nozzle hole punching step of the nozzle plate production method of the present invention.

Next, a description will be given of an operation of the press 103 and the nozzle hole punching step 123 performed by using the press 103. FIGS. 16A, 16B and 16C show the nozzle hole punching step 123 of the nozzle plate production method of the present invention.

When the base 158 is driven by the press 103, the upper die 155 and the holding plate 157 are lowered from the condition shown in FIG. 13A at a constant speed at the same time. The punch 160 at this time is set in the condition shown in FIG. 16A, and the sheet material 100 is clamped between the holding plate 157 and the lower die 156.

The upper die 155 is further lowered to the lowermost position. The punch 160 at this time shears the sheet material 100 as in the condition shown in FIG. 16B. A portion of the sheet material 100 on a bottom surface 100*b* of the sheet material 100 is downwardly bulged toward the inside of the die hole 163 by the leading edge of the punch 160. This portion forms the nib 141 which is produced in the nozzle hole punching step 123.

When the base 158 is lifted by the press 103, the upper die 155 is moved up together with the base 158. The leading edge of the punch 160 is, as in the condition shown in FIG. 16C, separated from a top surface 100*a* of the sheet material 100 which is clamped between the holding plate 157 and the lower die 156. After this, the holding plate 157 is moved up to the original position as in the condition shown in FIG. 13A.

In the condition shown in FIG. 16C, the nozzle hole 140 in the sheet material 100 is formed, and the nib 141 on the bottom of the sheet material 100 and the raised portion 142 on the top of the sheet material 100 around the nozzle hole 140 are produced. The nozzle hole 140 is formed into a shape which is substantially in accordance with the shape of the punch 160. As described above, the nozzle hole 140 (corresponding to the nozzle hole 21) has the tapered conical surface 22, the straight cylindrical surface 25 and the rounded interconnecting surface 26.

The raised portion 142 is produced by a part of the sheet material 10 on the top of the sheet material 100 when the leading edge of the punch 160 shears the sheet material 100. This part of the sheet material 100 is raised in directions indicated by the arrows "Q" in FIG. 16B, and the raised portion 142 is thus produced.

As the front-end portion of the punch 160 in the present embodiment is finished by lapping to provide the predetermined level of surface roughness, the inside surface of the nozzle hole 140 can be formed so as to have an equivalent level of surface roughness. Further, the punch 160 in the present embodiment has the protective film layer 174 of titanium nitride on the outside surface, and the shearing of the sheet material 100 by the punch 160 can be smoothly carried out to form the nozzle hole 140 with accuracy of the shape thereof.

It should be noted that in the nozzle plate production method of the present invention, the nozzle hole punching step 123 is repeated in first and second cycles to form all the nozzle holes 21 in the nozzle plate 20 of FIG. 6.

In the above-mentioned production method of the present invention, the first cycle of the nozzle hole punching step 123 is performed by lowering and lifting the punches 160 of the press 103. The nozzle holes 140 in the sheet material 100 are simultaneously formed by the press 103, and the number of the nozzle holes 140 being formed is half the number of the nozzle holes 21 in the nozzle plate 20 of FIG. 6. The nozzle holes 140 formed in the first cycle correspond to the nozzle holes 21 indicated by black dots in FIG. 6. After the first cycle is finished, the sheet material 100 is fed back in the longitudinal direction by a distance which is half the pitch P3 between two of the punches 160 (or equal to the pitch P2 between two of the guide holes 163 in the lower die 156). The backward feeding of the sheet material 100 is performed by using the feeder 250 shown in FIGS. 24A and 24B. After this, the second cycle of the nozzle hole punching step 123 is performed by using the press 103, and the remaining nozzle holes 140 in the sheet material 100 are simultaneously formed at positions displaced from the positions of the nozzle holes 140 previously formed in the first cycle. The nozzle holes 140 formed in the second cycle correspond to the nozzle holes 21 of the nozzle plate 20 indicated by white dots in FIG. 6.

In the above-mentioned production method of the present invention, the nibs 141 on the bottom surface of the sheet material 100, previously produced in the first cycle, are placed into the die holes 163*a* of the lower die 156 after the backward feeding of the sheet material 100. The nibs 141 on the bottom surface of the sheet material 100 are newly produced in the die holes 163 of the lower die 156 at the displaced positions when the second cycle is performed, and both the newly-produced nibs 141 and the previously-produced nibs 141 do not interfere with the die holes 163 of the lower die 156.

Figure 1:
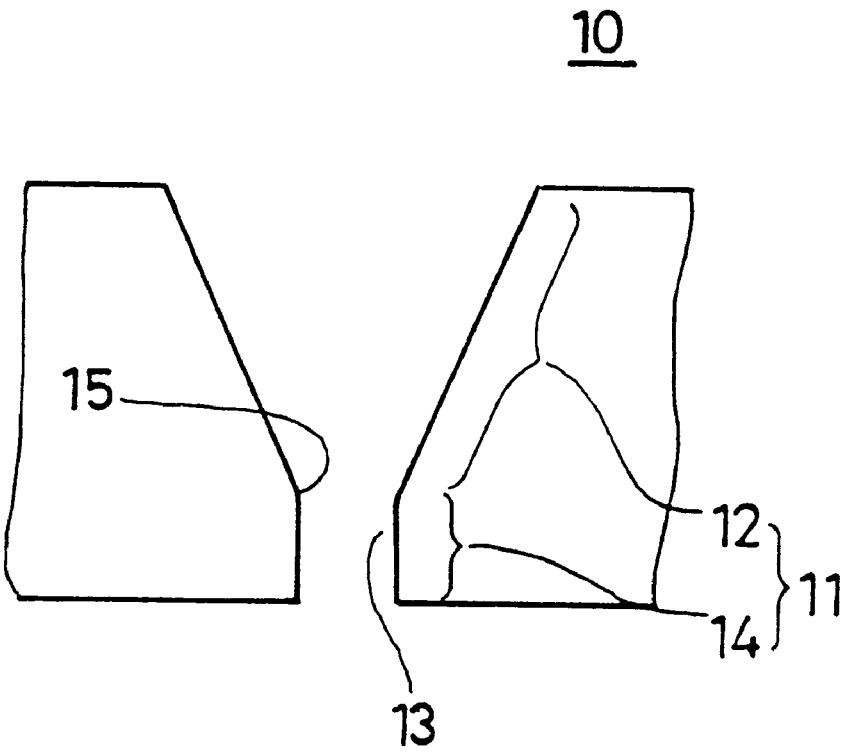
FIG. 1 PRIOR ART
FIG. 1 is a diagram showing a nozzle hole of a conventional nozzle plate.
Figure 2A:
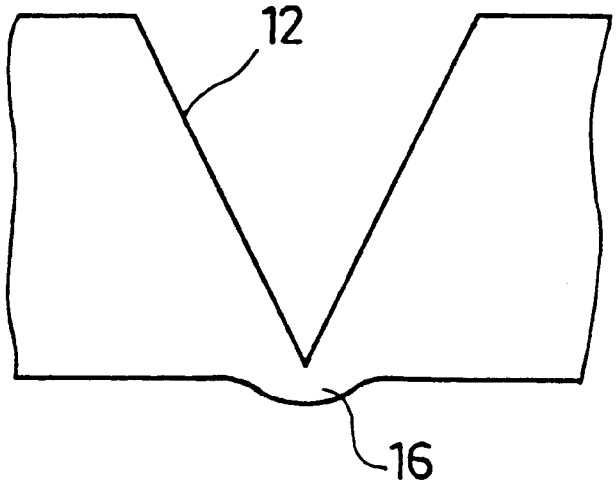
FIG. 2A PRIOR ART
FIGS. 2A, 2B and 2C are diagrams for explaining a conventional method of producing a nozzle plate.
Figure 2B:
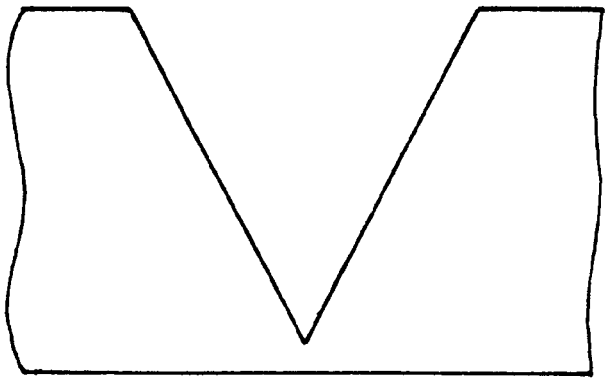
FIG. 2B PRIOR ART
Figure 2C:
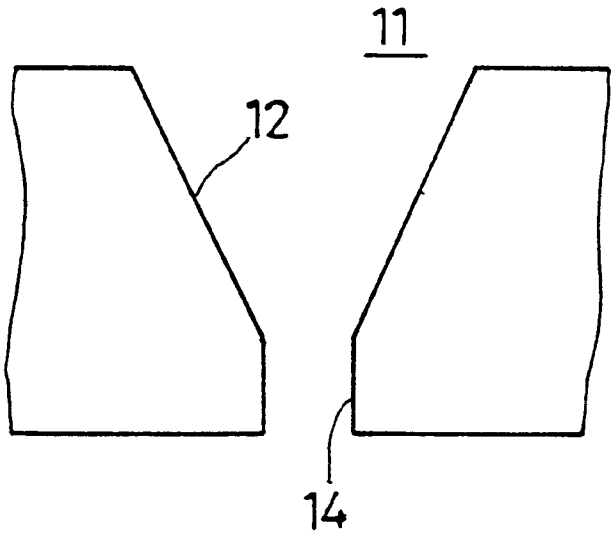
FIG. 2C PRIOR ART

Accordingly, in the above-mentioned production method of the present invention, it is possible to more easily produce the nozzle plate 20 including the nozzle holes 21 than in the conventional production method of FIGS. 2A–2C.

Figure 24A:
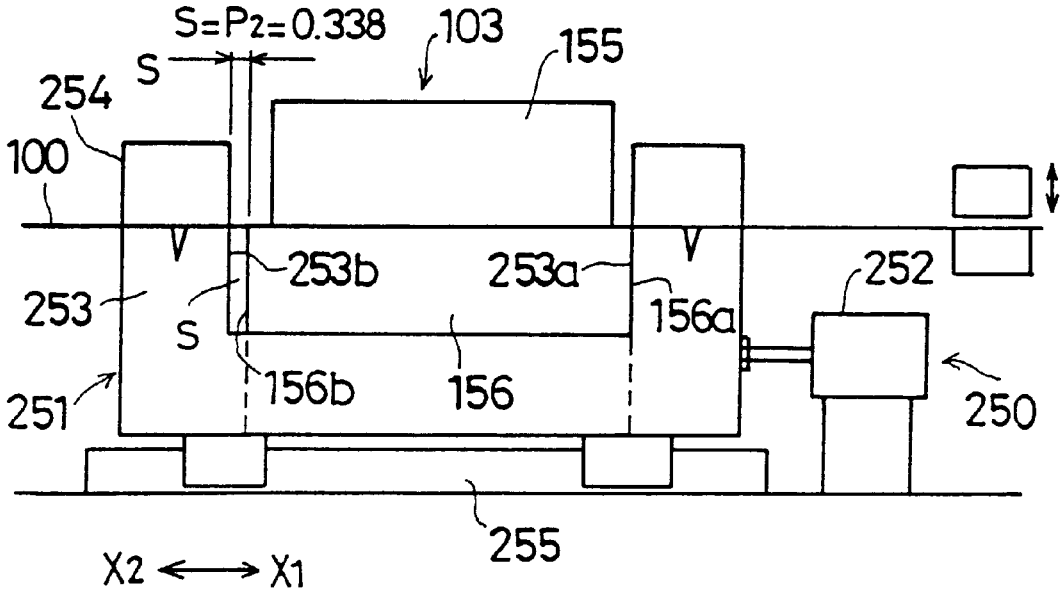
FIGS. 24A and 24B are diagrams showing a feeder of the nozzle plate production apparatus of the present invention.
Figure 24B:
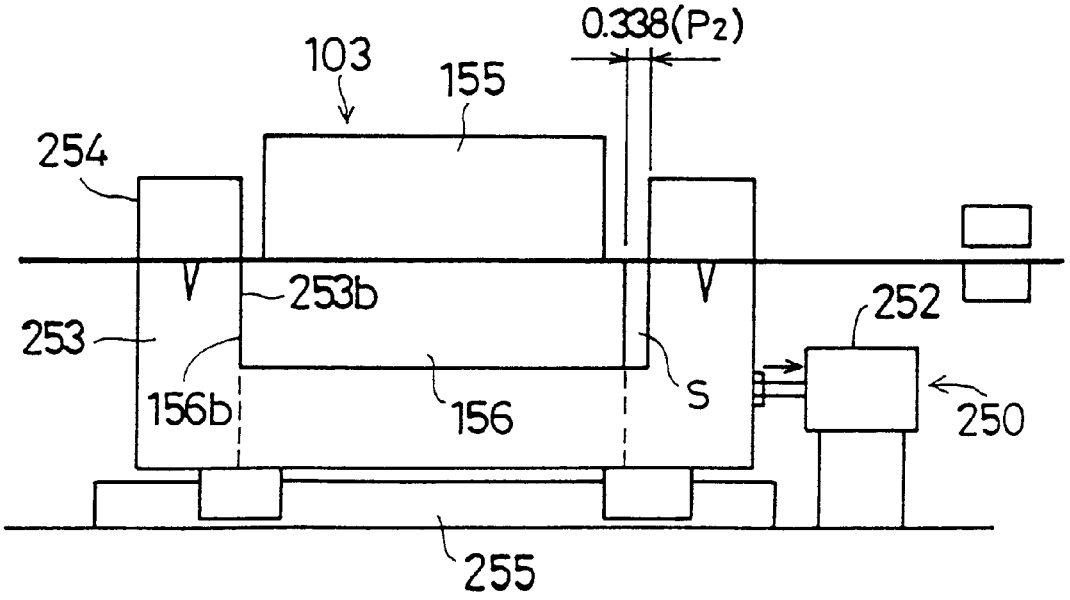

FIGS. 24A and 24B show the feeder 250 of the nozzle plate production apparatus of the present invention.

As shown in FIGS. 24A and 24B, the feeder 250 comprises a clamping device 251 and an actuator 252. The feeder 250 is provided within the press 103 and operated in association with the lowering and lifting operations of the upper die 155 of the press 103. The clamping device 251 clamps the sheet material 100. The actuator 252 moves the clamping device 251 relative to the lower die 156 of the press 103 in a direction indicated by the arrow "X1" in FIG. 24A in a reciprocating manner.

The clamping device 251 includes a lower clamper 253 and an upper clamper 254. When the press 103 is operated, the sheet material 100 is clamped between the lower damper 253 and the upper damper 254. The lower damper 253 is formed in a frame-like shape and is larger in size than the lower die 156 of the press 103. The lower damper 253 is arranged so as to encircle the lower die 156. The lower damper 253 is movably supported on guide rails 255, and the lower damper 253 is moved along the guide rails 255 by the actuator 252.

As shown in FIGS. 24A and 24B, the lower damper 253 has a first inside surface 253*a* and a second inside surface 253*b*, and the lower die 156 has a first outside surface 156*a* and a second outside surface 156*b*. The lower damper 253 and the lower die 156 are arranged with either a right-hand clearance "s" between the first inside surface 253*a* and the first outside surface 156*a* or a left-hand clearance "s" between the second inside surface 253*b* and the second outside surface 156*b*. Each of the clearances "s" is set at a distance that is equal to the above-mentioned pitch P2 (which is half the pitch P3).

When the actuator 252 is operated, the clamping device 251 is moved by the actuator 252 in the direction X1 in FIG. 24A, and the sheet material 100 clamped by the clamping device 251 is moved in the direction X1 relative to the press 103 within a range of the clearance between the lower die 156 and the clamping device 251. The sheet material 100 is first moved in a direction indicated by the arrow "X2" in FIG. 24A by the feeder 150, and then the sheet material 100 is moved in the opposite direction X1 by the distance, which is equal to the pitch P2, by the feeder 250.

When the first cycle of the nozzle hole punching step 123 for one of the nozzle plates to be produced is started, the clamping device 251 is moved to a position shown in FIG. 24A wherein the first inside surface 253*a* of the clamping device 251 is in contact with the first outside surface 156*a* of the lower die 156 and there is the left-hand clearance between the clamping device 251 and the lower die 156. When the first cycle of the nozzle hole punching step 123 is finished, the clamping device 251 is moved to a position shown in FIG. 25B by the actuator 252, wherein the second inside surface 253*b* of the clamping device 251 is in contact with the second output surface 156*b* of the lower die 156 and there is the right-hand clearance between the clamping device 251 and the lower die 156. At this time, the sheet material 100 is delivered together with the clamping device 251 in the direction X1 by the pitch P2 (or half the pitch P3).

When the second cycle of the nozzle hole punching step 123 is finished, the upper damper 254 is lifted from the lower damper 253, and the sheet material 100 is unclamped. The sheet material 100 is then moved in the direction X2 by the feeder 150. The clamping device 251 and the lower die 156 are placed in the condition of FIG. 24A, so that the first cycle of the nozzle hole punching step 123 for a following one of the nozzle plates to be produced is started.

Figure 17:
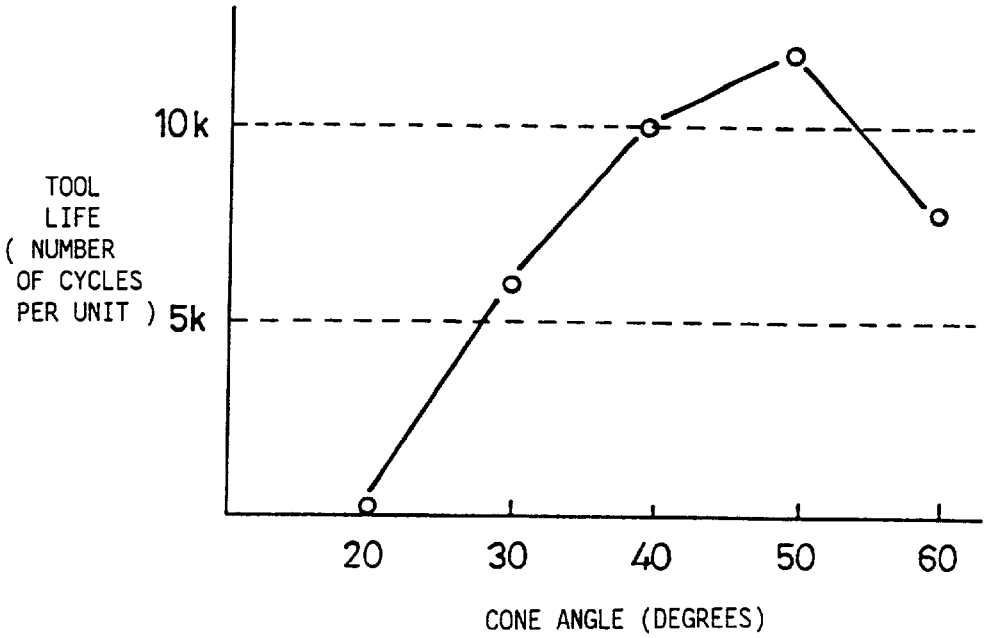
FIG. 17 is a graph for explaining tool life characteristics obtained by a testing for a number of punches having different cone angles.

FIG. 17 shows tool life characteristics obtained by tool life testing for a number of punches having different cone angles.

For the purpose of tool life testing, a number of punches 160 which include the tapered conical portions 172 having different cone angles "α10" were prepared. The tool life testing was conducted by repeating press operations using each of the prepared punches, and a tool life of each punch was obtained. The tool life is determined by the number of punch operation cycles being repeated for that punch until the surface roughness of a nozzle hole formed by the punch being tested becomes deficient or until the punch being tested is broken.

In the tool life characteristics of FIG. 17, the punches tested have the conical portions 172 with cone angles "α10": 20°, 30°, 40°, 50° and 60°. The lower die 156 combined with each of the punches when testing has the die holes 163 with the diameter "d12":0.20 mm. In the tool life characteristics of FIG. 17, it is found that the punches with the cone angles "α10": 30°, 40°, 50° and 60° show an adequate level of tool life. As shown in FIG. 17, the number of repeated cycles with respect to these punches is in a range of between 6,000 and 12,000.

In the present embodiment of the punch 160, the cone angle "α10" of the conical portion 172 is set at about 40°. Therefore, it is possible for the present embodiment of the punch 160 to provide an adequate level of tool life.

Figure 18:
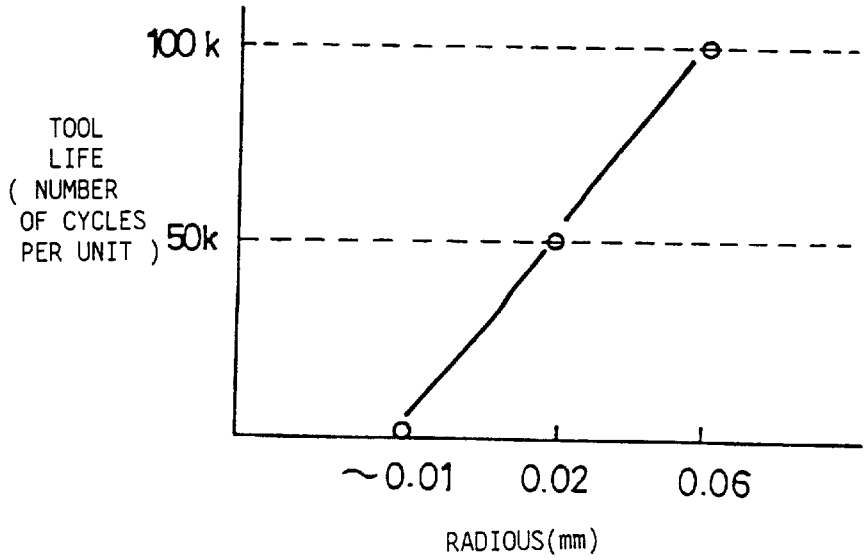
FIG. 18 is a graph for explaining tool life characteristics obtained by a testing for a number of punches having different interconnecting portion radii.

FIG. 18 shows tool life characteristics obtained by tool life testing for a number of punches having different interconnecting portion radii.

For the purpose of tool life testing, a number of punches 160 which include the rounded interconnecting portions 173 having different radii "r10" are prepared. The tool life testing is conducted by repeating press operations with a related one of the prepared punches, and a tool life of the punch is obtained for each of the prepared punches in a similar manner.

In the tool life characteristics of FIG. 18, the punches tested have the interconnecting portions 173 with the radii "r10": 0.01 mm, 0.03 mm and 0.06 mm. The lower die 156 combined with each of the punches when testing has the die holes 163 with the diameter "d12": 0.20 mm. In the tool life characteristics of FIG. 18, it is found that the punches with the radii "r10" in the range between 0.02 mm and 0.06 mm show an adequate level of tool life. As shown in FIG. 18, the number of repeated cycles with respect to these punches is in a range of between 5,000 and 100,000.

In the present embodiment of the punch 160, the radius "r10" of the interconnection portion 173 is set at about 0.02 mm. Therefore, it is possible for the present embodiment of the punch 160 to provide an adequate level of tool life.

Figure 19:
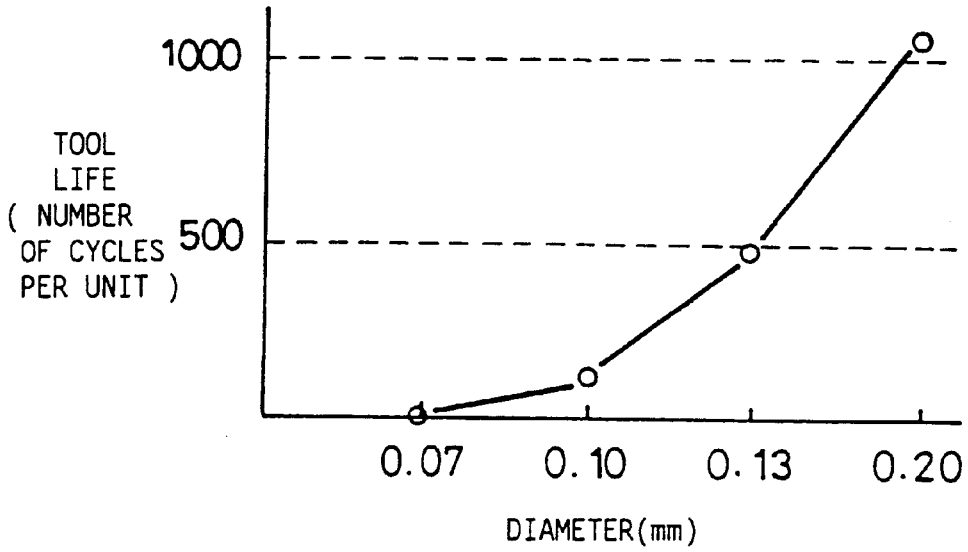
FIG. 19 is a graph for explaining tool life characteristics obtained by a testing for a punch combined with one of a number of lower dies having different die hole diameters.

FIG. 19 shows tool life characteristics obtained by tool life testing for a punch which is combined with a respective one of a number of lower dies having different die hole diameters when the testing is conducted.

For the purpose of tool life testing, a number of lower dies 156 having the die holes 163 with different diameters "d12" were prepared. The punch 160 combined with the respective one of the prepared lower dies 156 had the conical portion 172 with the cone angle "α10": 30°. The tool life testing was conducted by repeating press operations with a related one of the prepared lower dies in combination with the punch, and a tool life of the punch was obtained for each of the prepared lower dies in a similar manner.

In the tool life characteristics of FIG. 19, the lower dies 156 tested have the die holes 163 with the respective diameters "d12": 0.07 mm, 0.10 mm, 0.13 mm and 0.20 mm. It was found from the tool life characteristics of FIG. 19 that the diameter "d12" of the die holes 163 of the lower die has to be in a range of between 0.13 mm and 0.20 mm in order to provide an adequate level of tool life for the punch. As shown in FIG. 19, the number of repeated cycles obtained for the punch combined with the lower dies 156 which satisfy the above-mentioned requirement is in a range of between 500 and 1,000.

In the present embodiment of the lower die 156 combined with the punch 160, the diameter "d12" of the die holes 163 is set at about 0.2 mm. Therefore, it is possible for the present embodiment of the punch 160 to provide an adequate level of tool life.

Further, for the purpose of tool life testing, the punches 160 having the protective film layer 174 of titanium nitride and punches having no protective film layer 174 were prepared. The protective film layer 174 was formed on the outside surface of the punches 160 through ion plating. The tool life testing was conducted by repeating press operations using each of the prepared punches, and a tool life of each punch was obtained.

From the results of the tool life testing, it is found that the punches 160 having the protective film layer 174 show a level of tool life much higher than a level of tool life of the punches having no protective film layer 174. In the present embodiment of the punch 160, the protective film layer 174 is formed on the outside surface of the punch 160, and it is possible for the present embodiment of the punches 160 to provide an adequate level of tool life.

Figure 20A:
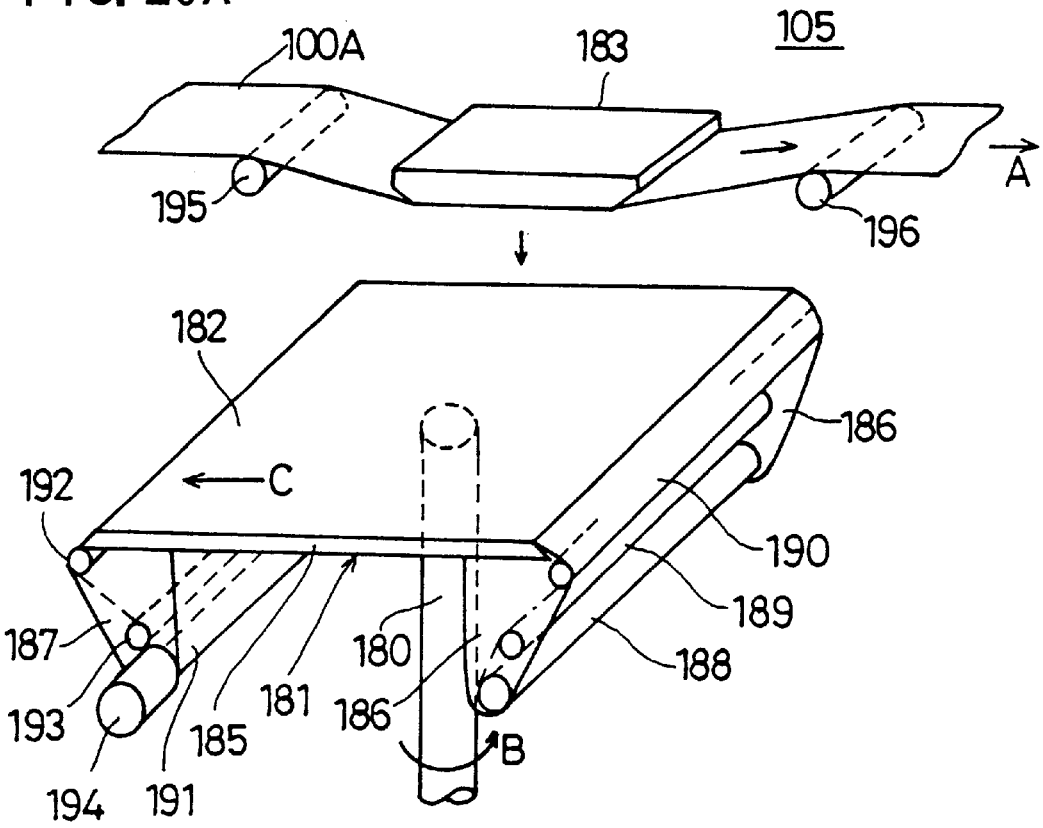
FIGS. 20A and 20B are diagrams showing a tape grinding machine of the nozzle plate production apparatus of the present invention.
Figure 20B:
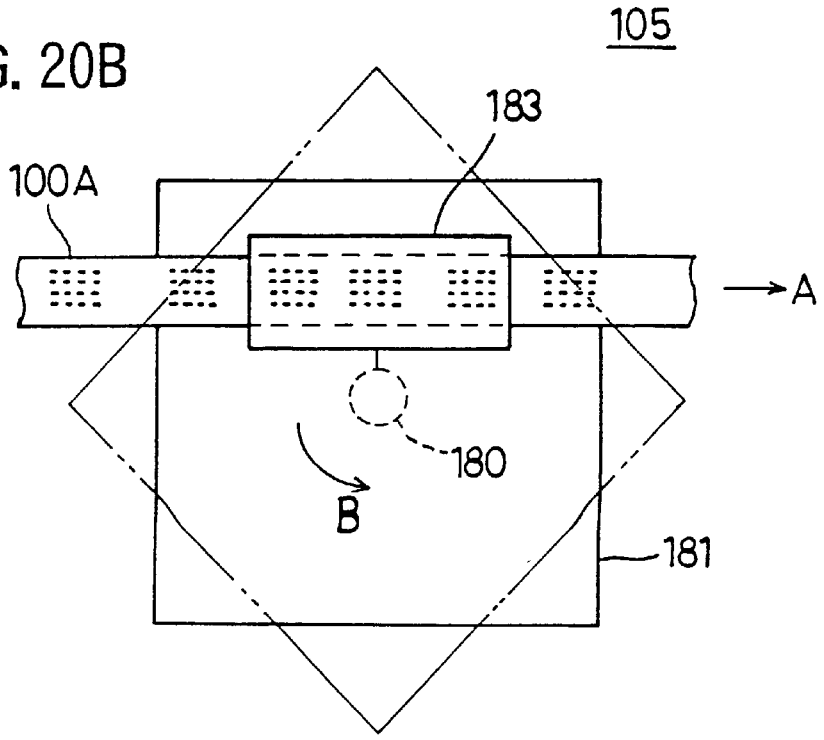

FIGS. 20A and 20B show the tape grinding machine 105 of the nozzle plate production apparatus of the present invention. As described above, the tape grinding machine 105 is used when the nib removal step 125 is performed.

As shown in FIGS. 20A and 20B, the tape grinding machine 105 comprises a center shaft 180, a rotary table unit 181, an abrasive tape 182 and a holding plate 183. The center shaft 180 extends in a vertical direction. The rotary table unit 181 is rotated around the center shaft 180 in a direction indicated by the arrow "B" in FIGS. 20A and 20B.

The rotary table unit 181 includes a square rotary table 185 and two flanges 186 and 187 which are outwardly extending from both sides of the rotary table 185. In the rotary table unit 181, an abrasive tape supply reel 188 and guide rolls 189 and 190 are attached to the flange 186, and an abrasive tape take-up reel 191 and guide rolls 192 and 193 are attached to the flange 187. An abrasive tape winding device 194 is secured to the flange 187 and rotates the take-up reel 191 so that the abrasive tape 182 from the supply reel 188 is wound on the take-up reel 191 in a direction indicated by the arrow "C" in FIG. 20A. The rotary table 185 has a width that is substantially the same as a width of the abrasive tape 182.

The abrasive tape 182 from the supply reel 188 is guided by the guide rolls 189 and 190 and passed through the top surface of the rotary table 185, and the abrasive tape 182 from the opposite side of the rotary table 185 is guided by the guide rolls 192 and 193 and extends to the take-up reel 191.

The holding plate 183 is in a rectangular shape and has the larger side extending in the longitudinal direction of the sheet material 100. As shown in FIG. 20B, the holding plate 183 is arranged at a position spaced apart from the center shaft 180. The holding plate 183 is normally separated from the top surface of the rotary table 185 as shown in FIG. 20A. When the nib removal step 125 is performed for the sheet material 100, the holding plate 183 is lowered so that the sheet material 100 held by the holding plate 183 is brought into the abrasive tape 182 on the rotary table 185. As shown in FIG. 20B, the holding plate 183 has a width in the longitudinal direction of the sheet material 100 that is greater than a total width of three pieces of the nozzle plates. As shown in FIG. 20A, a tension roller 195 and a tension roller 196 are arranged on the bottom of the sheet material 100 at positions spaced apart from both sides of the holding plate 183.

The sheet material 100A in which the nibs 141 on the bottom surface of the sheet material 100A is delivered in a direction indicated by the arrow "A" in FIGS. 20A and 20B. The sheet material 100A is guided by the tension rollers 195 and 196 and brought into contact with the bottom surface of the holding plate 183.

When the nibs 141 are removed in the nib removal step 125, the holding plate 183 is lowered, the rotary table unit 181 is rotated in the direction "B", and the abrasive tape winding device 194 is operated. The abrasive tape 182 is delivered at a low speed on the rotary table 185 in the direction "C" and rotated in the direction "B" by the rotary table 185 around the center shaft 180. The holding plate 183 presses the sheet material 100A against the abrasive tape 182 on the rotary table 185. Therefore, the nibs 141 are removed from the sheet material 100A by the abrasive tape 182 as shown in FIG. 20B.

Figure 21A:
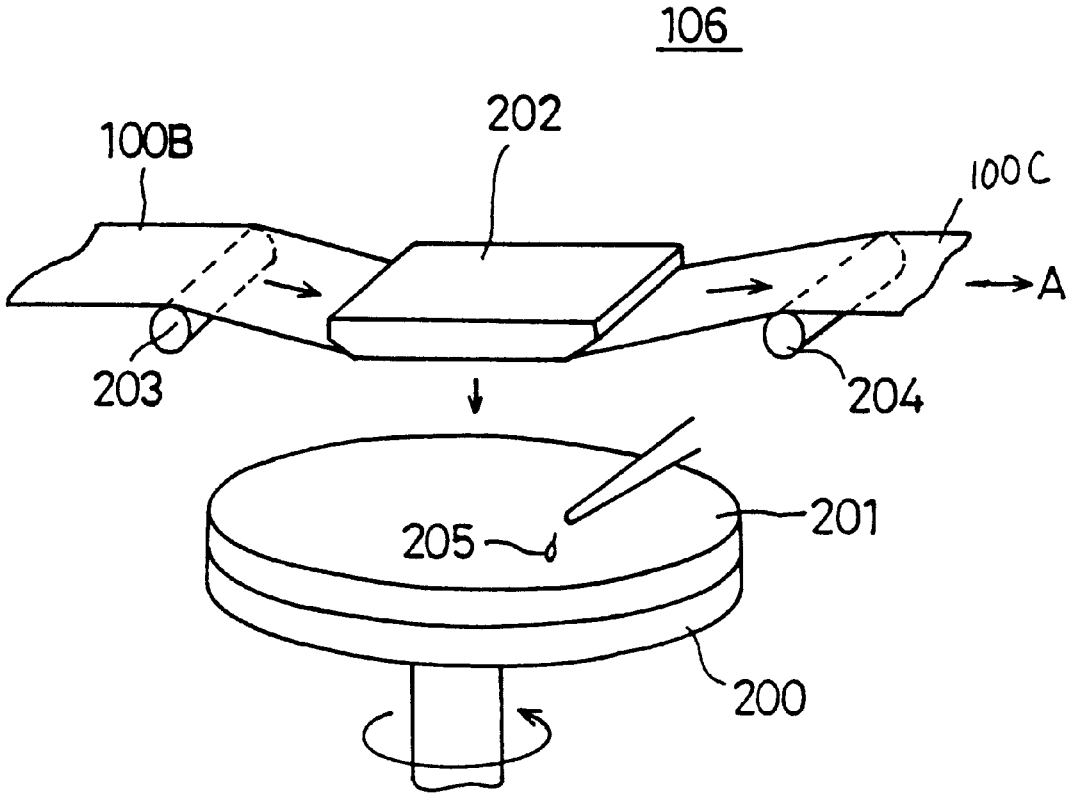
FIGS. 21A and 21B are diagrams showing a buffing machine of the nozzle plate production apparatus of the present invention.
Figure 21B:
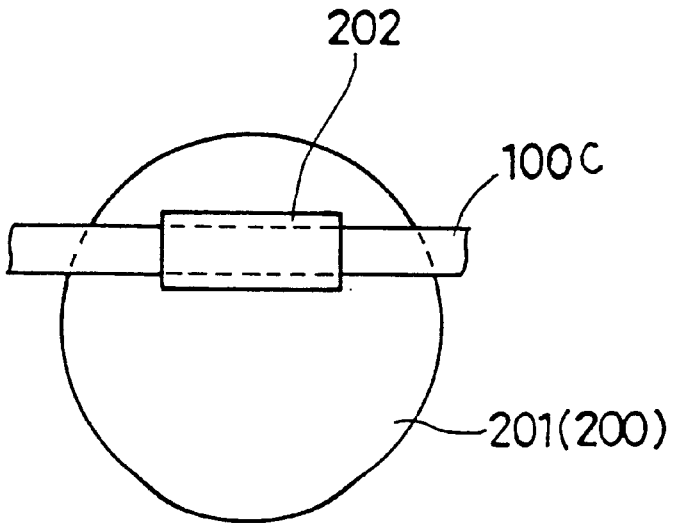

FIGS. 21A and 21B show the buffing machine 106 of the nozzle plate production apparatus of the present invention. As described above, the buffing machine 106 is used when the buffing step 126 is performed.

As shown in FIGS. 21A and 21B, the buffing machine 106 comprises a circular rotary table 200, a circular polishing sheet 201, a holding plate 202, and guide rollers 203 and 204. The rotary table 200 is rotated in a direction indicated by the arrow in FIG. 21A around a center shaft. The polishing sheet 201 is rotated in the same direction together with the rotary table 200. The holding plate 202 is brought into contact with the sheet material 100 and lowered to the polishing sheet 201 on the rotary table 200, similarly to the holding plate 183 of FIGS. 20A and 20B. The sheet material 100 is guided by the guide rollers 203 and 204.

When the buffing step 126 is performed with the buffing machine 106 for the sheet material 100B, the holding plate 202 is lowered, and the sheet material 100B which is delivered in the direction "A" is pressed against the polishing sheet 201 which is rotated. An abrasive 205 is supplied to the polishing sheet 201. The buffing step 126 is thus performed with the buffing machine 106, and the top and bottom surfaces of the sheet material 100B are buffed to provide the predetermined level of surface roughness.

Figure 22:
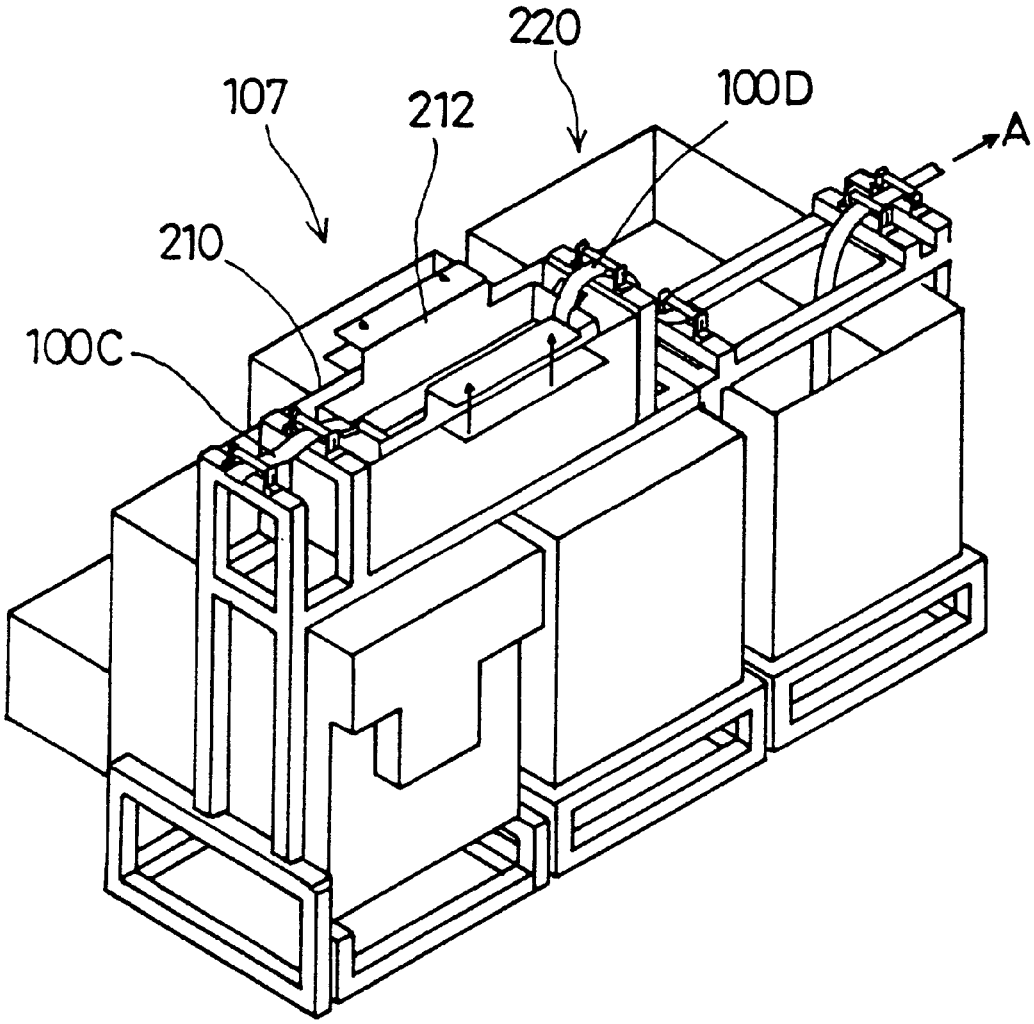
FIG. 22 is a view of an ultrasonic cleaning machine of the nozzle plate production apparatus of the present invention.
Figure 23:
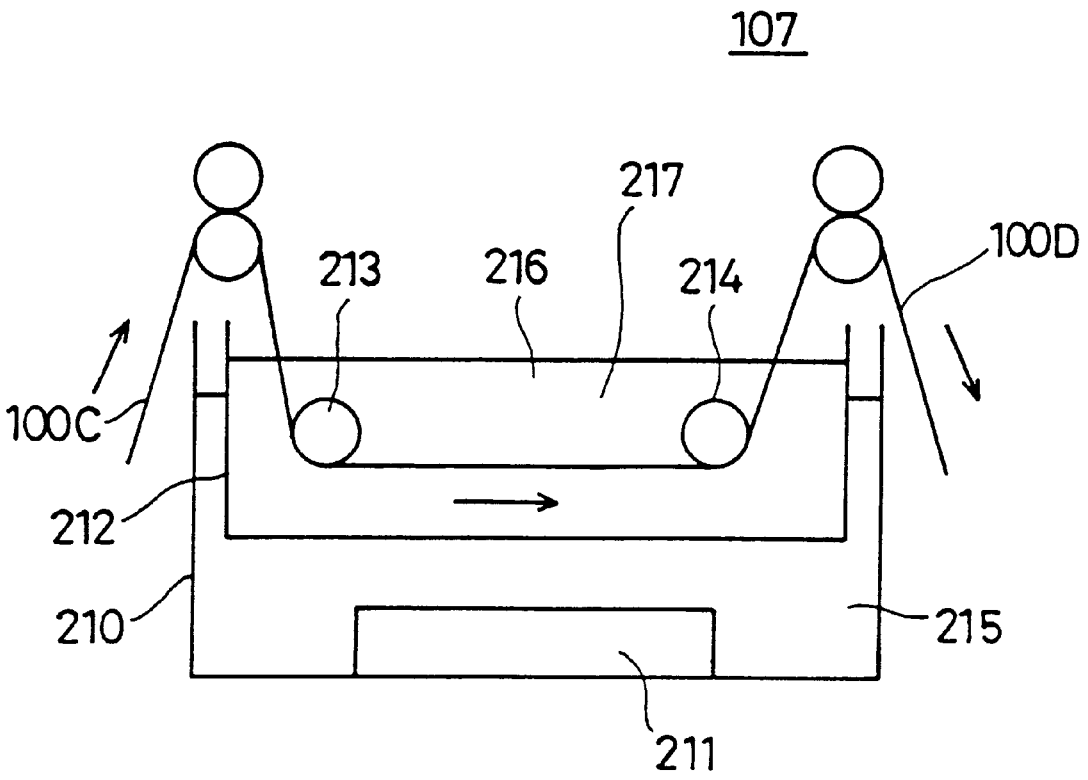
FIG. 23 is a diagram for explaining an operation of the ultrasonic cleaning machine of FIG. 22.

FIG. 22 is a view of the ultrasonic machine 107 of the nozzle plate production apparatus of the present invention. FIG. 23 shows an operation of the ultrasonic machine 107. As described above, the ultrasonic machine 107 is used when the burr removal step 127 is performed.

As shown in FIGS. 22 and 23, the ultrasonic machine 107 comprises an outside container 210, an ultrasonic oscillator 211, an inside container 212, and guide rolls 213 and 214. The outside container 210 contains a water 215 with a low purity, and the inside container 212 contains a water 216 with a high purity. The inside container 212 is arranged within the outside container 210, and the inside container 212 floats in the water 215 of the outside container 210. The ultrasonic oscillator 211 is arranged on an inside bottom surface of the outside container 210. The guide rolls 213 and 214 are arranged within the inside container 212. In the high-purity water 216 of the inside container 212, alumina chips 217 are dispersed.

When the burr removal step 127 is performed, the ultrasonic oscillator 211 is operated, and the sheet material 100C in which the burrs 143 and 144 on the top and bottom surfaces are produced by the buffing step 125 is passed through the high-purity water 216 of the inside container 212 while it is guided by the guide rollers 213 and 214. Vibrations of the water 215 generated by the ultrasonic oscillator 211 are transmitted to the high-purity water 216 of the inside container 212. The alumina chips 217 are subject to such vibrations of the water 216 of the inside container 212, and the burrs 143 and 144 are thus removed from the sheet material 100C by the alumina chips 217. By using the ultrasonic machine 107, the burrs 143 and 144 are removed from the sheet material 100C without harming the sheet material 100C.

The sheet material 100D from which the burrs 143 and 144 are removed by the burr removal step 127 is delivered to a shower rinse air blow container 220 (shown in FIG. 22) provided adjacent to the ultrasonic machine 107.

The buffing step 128 of the nozzle plater production method of the present invention is performed similarly to the buffing step 126. The buffing machine 108 used when the buffing step 128 is performed is substantially the same as the buffing machine 106 shown in FIGS. 21A and 21B.

In the above-described embodiments, the nozzle plate production method and apparatus of the present invention and the nozzle plate 20 produced by the same are applied to a nozzle plate of a piezoelectric ink-jet head. However, the present invention is not limited to the above-described embodiment, and is applicable to a nozzle plate of an ink-jet head of another type.

Further, the present invention is not limited to the above-described embodiments, and variations and modifications may be made without departing from the present invention.

What is claimed is:

1. A nozzle plate of an inkjet head printer, said nozzle plate having a plurality of nozzle holes arranged in the nozzle plate, each of the nozzle holes comprising:

a tapered conical surface extending from a first opening of the nozzle hole to a conical surface end, said tapered conical surface having been formed by a punch having a corresponding conical punch surface with a cone angle of from 30° to 60°;

a straight cylindrical surface extending from a second opening of the nozzle hole to a cylindrical surface end; and a rounded interconnecting surface smoothly interconnecting said tapered conical surface and said cylindrical surface, wherein said interconnecting surface has a radius in a range of between 0.02 mm and 0.06 mm, said radius of said rounded interconnecting surface being defined from the conical surface end to the cylindrical surface end.

2. The nozzle plate according to claim 1, wherein said tapered conical surface of each said nozzle hole has a cone angle of from about 40° to 50°.

3. The nozzle plate according to claim 1, wherein said nozzle plate has an ink discharge spreading angle in a range of ±0.4 degrees.

4. The nozzle plate according to claim 1, wherein said tapered conical surface of each said nozzle hole has a cone angle of about 40°.

5. The nozzle plate according to claim 1, wherein said tapered conical surface has been formed by a punch having a corresponding conical punch surface with a cone angle of from 40° to 50°.

6. A nozzle plate of an ink jet head printer, said nozzle plate having a plurality of nozzle holes arranged in the nozzle plate, each of the nozzle holes comprising:

a tapered conical surface extending from a first opening of the nozzle hole to a conical surface end, said tapered conical surface having been formed by a punch having a corresponding conical punch surface with a cone angle of from 30° to 60°;

a straight cylinder surface extending from a second opening of the nozzle hole to a cylindrical surface end; and a rounded interconnecting surface smoothly interconnecting said tapered conical surface and said cylindrical surface, wherein said interconnecting surface has a radius in a range of between 0.02 mm and 0.06 mm, said radius of said rounded interconnecting surface being defined from the conical surface end to the cylindrical surface end, and said cylindrical surface has a depth set at about one eighth of a thickness of the nozzle plate, said tapered conical surface having a depth set at about five eighths of the thickness of the nozzle plate, and said interconnecting surface having a depth set at about one fourth of the thickness of the nozzle plate, said depth of said interconnecting surface being defined from the conical surface end to the cylindrical surface end.

7. The nozzle plate according to claim 6, wherein said tapered conical surface of each said nozzle hole has a cone angle of from about 40° to 50°.

8. The nozzle plate according to claim 6, wherein said nozzle plate has an ink discharge spreading angle in a range of ±0.4 degrees.

9. The nozzle plate according to claim 6, wherein said tapered conical surface of each said nozzle hole has a cone angle of about 40°.

10. The nozzle plate according to claim 6, wherein said tapered conical surface has been formed by a punch having a corresponding conical punch surface with a cone angle of from 40° to 50°.

* * * * *